US008441401B2

(12) United States Patent
Steinkamp et al.

(10) Patent No.: US 8,441,401 B2
(45) Date of Patent: May 14, 2013

(54) VEHICLE ANTENNA MOUNTING APPARATUS, SYSTEMS, AND METHODS

(75) Inventors: Ulrich Steinkamp, Hannover (DE); Jens Simon, Algermissen (DE); Rainer Ecker, Göppingen (DE); Otto Heinemeyer, Dassel (DE)

(73) Assignee: Laird Technologies, Inc., Earth City, MO (US)

( * ) Notice: Subject to any disclaimer, the term of this patent is extended or adjusted under 35 U.S.C. 154(b) by 562 days.

(21) Appl. No.: 12/772,750

(22) Filed: May 3, 2010

(65) Prior Publication Data

US 2011/0267243 A1 Nov. 3, 2011

Related U.S. Application Data

(60) Provisional application No. 61/329,210, filed on Apr. 29, 2010.

(51) Int. Cl.
*H01Q 1/12* (2006.01)
*H01Q 1/32* (2006.01)

(52) U.S. Cl.
USPC ..... 343/713; 343/715; 343/878

(58) Field of Classification Search ..... 343/713, 343/715, 878; 248/534, 231.21, 231.9
See application file for complete search history.

(56) References Cited

U.S. PATENT DOCUMENTS

| | | | |
|---|---|---|---|
| 2,496,866 | A | 2/1950 | Flora |
| 4,090,030 | A | 5/1978 | Lagasse |
| 5,697,797 | A | 12/1997 | Wendel |
| 6,157,345 | A | 12/2000 | Hockett et al. |
| 6,486,841 | B1 | 11/2002 | Imahigashi |
| 6,714,171 | B2 | 3/2004 | Haussler et al. |
| 6,762,727 | B2 | 7/2004 | Rochford et al. |
| 6,879,301 | B2 | 4/2005 | Kozlovski |
| 6,930,643 | B2 | 8/2005 | Byrne et al. |
| 7,004,666 | B2 | 2/2006 | Kozlovski |
| 7,088,297 | B2 | 8/2006 | Nakano et al. |
| 7,212,168 | B2 | 5/2007 | Kozlovski |
| 7,236,136 | B2 | 6/2007 | Noro |
| 7,274,341 | B2 | 9/2007 | Ohno et al. |
| 7,429,958 | B2 | 9/2008 | Lindackers et al. |
| 7,492,319 | B2 | 2/2009 | Lindackers et al. |
| 7,564,417 | B2 | 7/2009 | Tengler et al. |
| 7,710,333 | B2 | 5/2010 | Byrne et al. |
| 2005/0237248 | A1 | 10/2005 | Nakano et al. |
| 2007/0279302 | A1 | 12/2007 | Byrne et al. |
| 2008/0074342 | A1 | 3/2008 | Lindackers et al. |

(Continued)

FOREIGN PATENT DOCUMENTS

| | | |
|---|---|---|
| DE | 20117628 | 2/2002 |
| DE | 102004037813 | 10/2005 |

(Continued)

*Primary Examiner* — Michael C Wimer
(74) *Attorney, Agent, or Firm* — Harness, Dickey & Pierce, P.L.C.

(57) ABSTRACT

Disclosed herein are exemplary embodiments of apparatus, systems, and methods relating to mounting antenna components, modules, assemblies, etc. to mounting surfaces, such as vehicle roofs, hoods, trunk lids, etc. Other aspects relate to antenna assemblies including the mounting apparatus. An exemplary embodiment generally includes one or more contact parts, a clamping piece, and a fastener. The one or more contact parts, clamping piece, and fastener may be used for mounting an antenna assembly to a mounting surface, such as a vehicle body wall (e.g., a vehicle's roof, hood, trunk lid, etc.).

32 Claims, 21 Drawing Sheets

U.S. PATENT DOCUMENTS

| | | | | |
|---|---|---|---|---|
| 2008/0131199 | A1 | 6/2008 | Hildebrand | |
| 2009/0284439 | A1 | 11/2009 | Rode et al. | |
| 2011/0017899 | A1* | 1/2011 | Lerchner | 248/534 |
| 2011/0133047 | A1* | 6/2011 | Lerchner | 248/231.21 |

FOREIGN PATENT DOCUMENTS

| | | | |
|---|---|---|---|
| DE | 10210593 | B4 | 8/2007 |
| DE | 60315174 | | 4/2008 |
| EP | 1742292 | | 1/2007 |
| EP | 2064775 | | 6/2009 |
| EP | 2120284 | | 11/2009 |
| WO | WO00/35045 | | 6/2000 |
| WO | WO03/107477 | | 12/2003 |
| WO | WO2006/087225 | | 8/2006 |
| WO | WO2007/098996 | | 9/2007 |
| WO | WO2008039592 | | 4/2008 |

* cited by examiner

VEHICLE ANTENNA MOUNTING APPARATUS, SYSTEMS, AND METHODS

CROSS-REFERENCE TO RELATED APPLICATION

This application claims the benefit of U.S. Provisional Application No. 61/329,210, filed on Apr. 29, 2010. The entire disclosure of this application is incorporated herein by reference.

FIELD

The present disclosure generally relates to apparatus, systems, and methods relating to mounting antenna components, modules, assemblies, etc. to mounting surfaces, such as vehicle roofs, hoods, trunk lids, etc.

BACKGROUND

This section provides background information related to the present disclosure which is not necessarily prior art.

Various antenna types are used in the automotive industry, including aerial AM/FM antennas, patch antennas, etc. Antennas for automotive use are commonly positioned on the vehicle's roof, hood, or trunk lid to help provide the antenna with an unobstructed view overhead or towards the zenith.

SUMMARY

This section provides a general summary of the disclosure, and is not a comprehensive disclosure of its full scope or all of its features.

Disclosed herein are exemplary embodiments of apparatus, systems, and methods relating to mounting antenna components, modules, assemblies, etc. to mounting surfaces, such as vehicle roofs, hoods, trunk lids, etc. Other aspects relate to antenna assemblies including the mounting apparatus.

An exemplary embodiment generally includes one or more contact parts, a clamping piece, and a fastener. The one or more contact parts, clamping piece, and fastener may be used for mounting an antenna assembly to a mounting surface, such as a vehicle body wall (e.g., a vehicle's roof, hood, trunk lid, etc.).

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
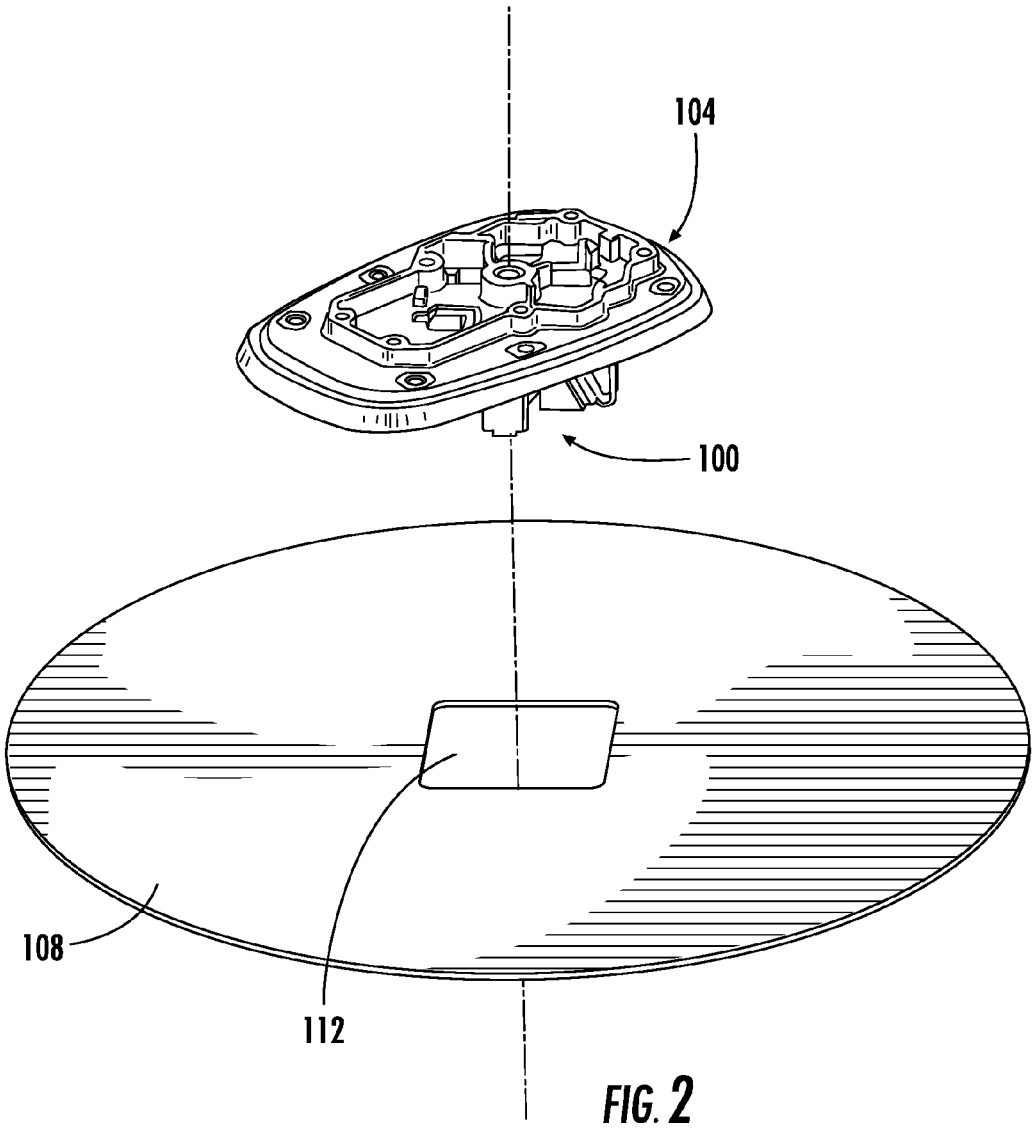
FIG. 2 is a perspective view of the antenna assembly shown in FIG. 1 assembled and aligned with a mounting hole in a vehicle body wall into the interior compartment side of the vehicle.
Figure 3:
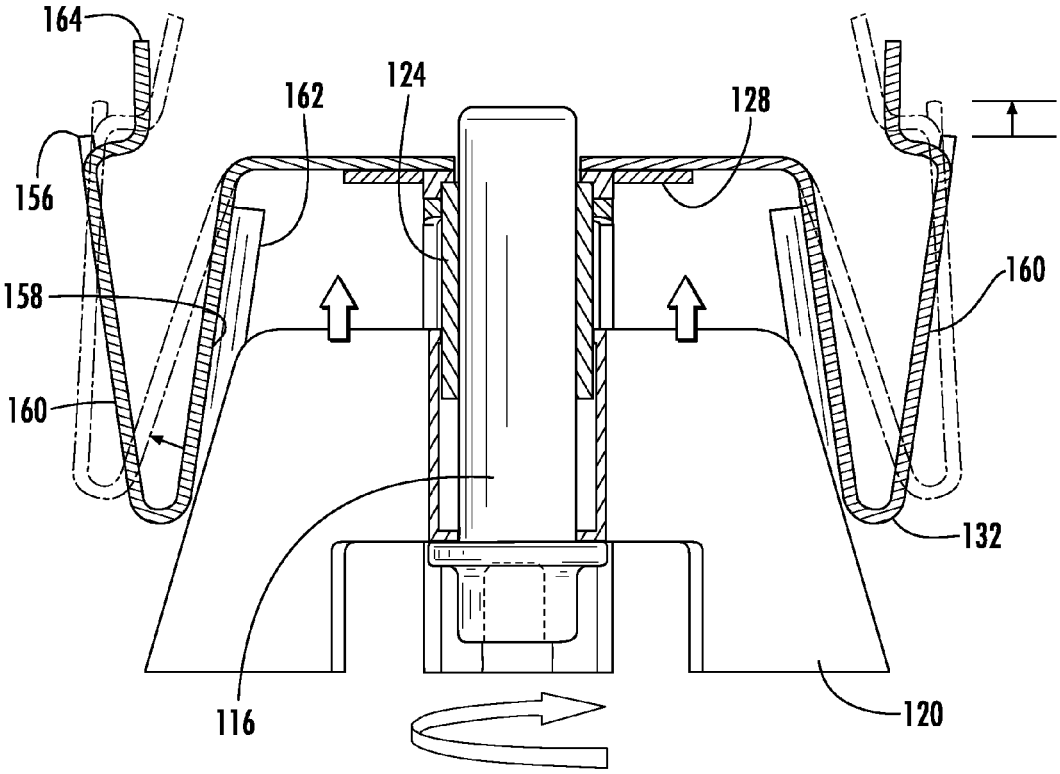
FIG. 3 illustrates the interaction of the fastener, clamping piece, sleeve, and brackets shown in FIG. 1, and illustrating the manner in which the fastener may be rotated to move the clamping piece toward the vehicle body wall to elastically deform the brackets (as represented by the broken lines) for mounting an antenna assembly shown to the vehicle body wall according to an exemplary embodiment.
Figure 8:
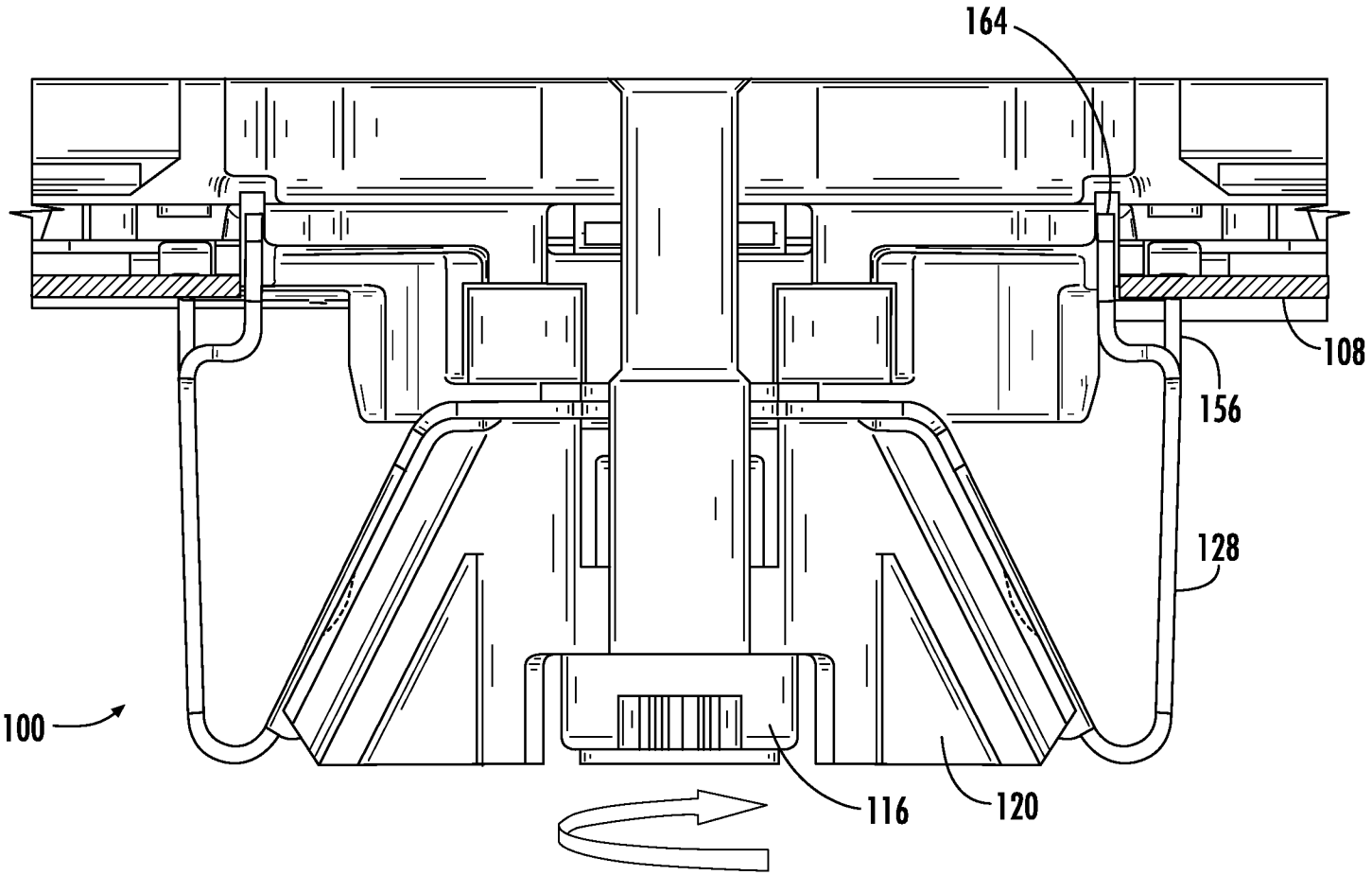
Figure 13:
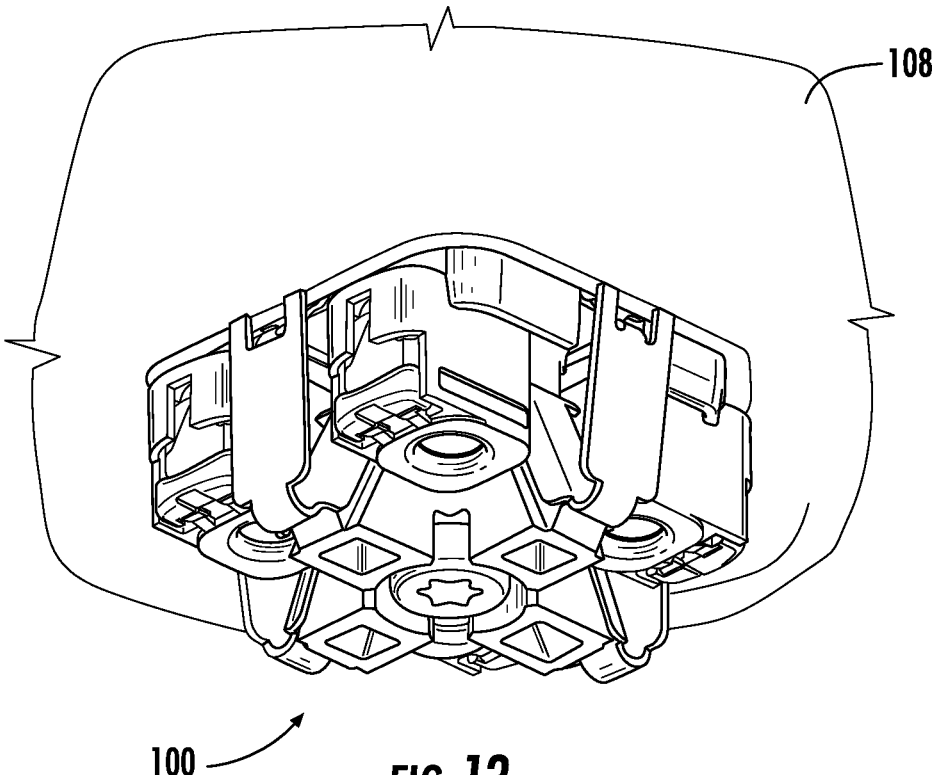
Figure 14:
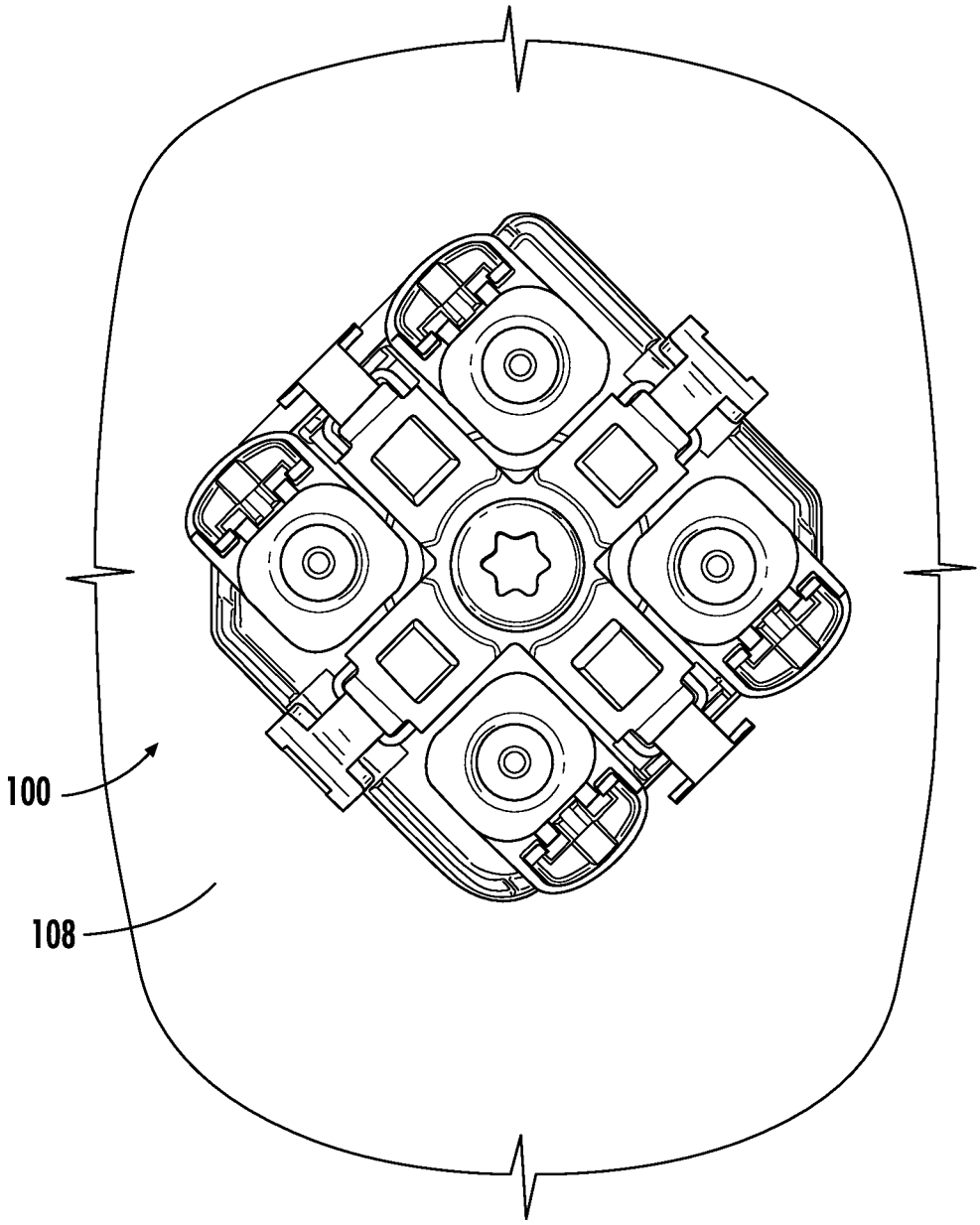
Figure 15:
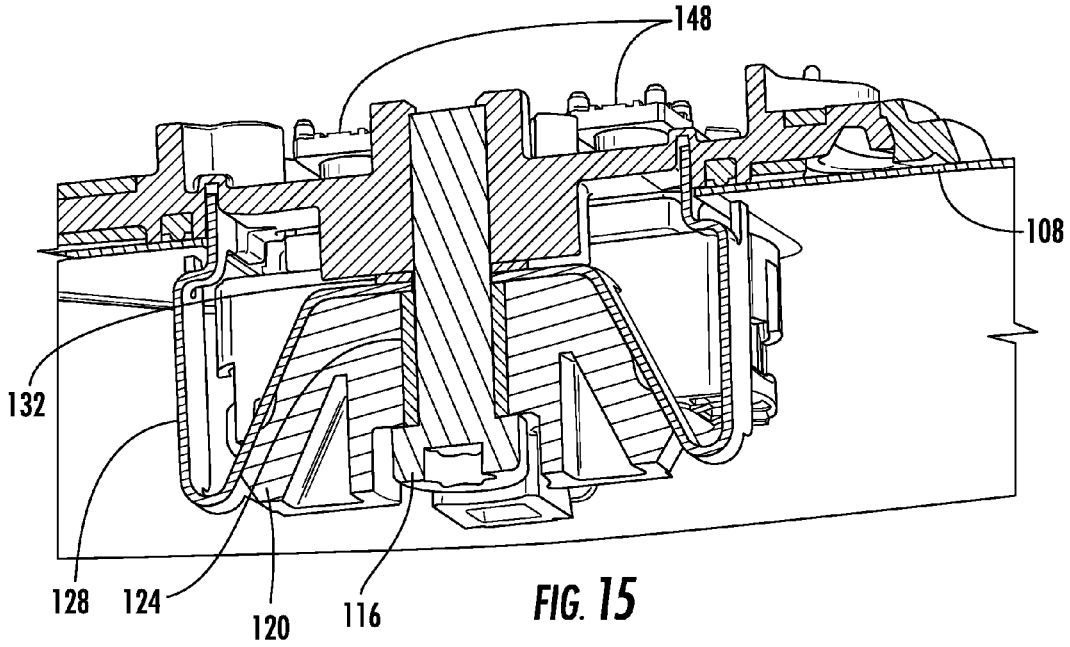
Figure 16:
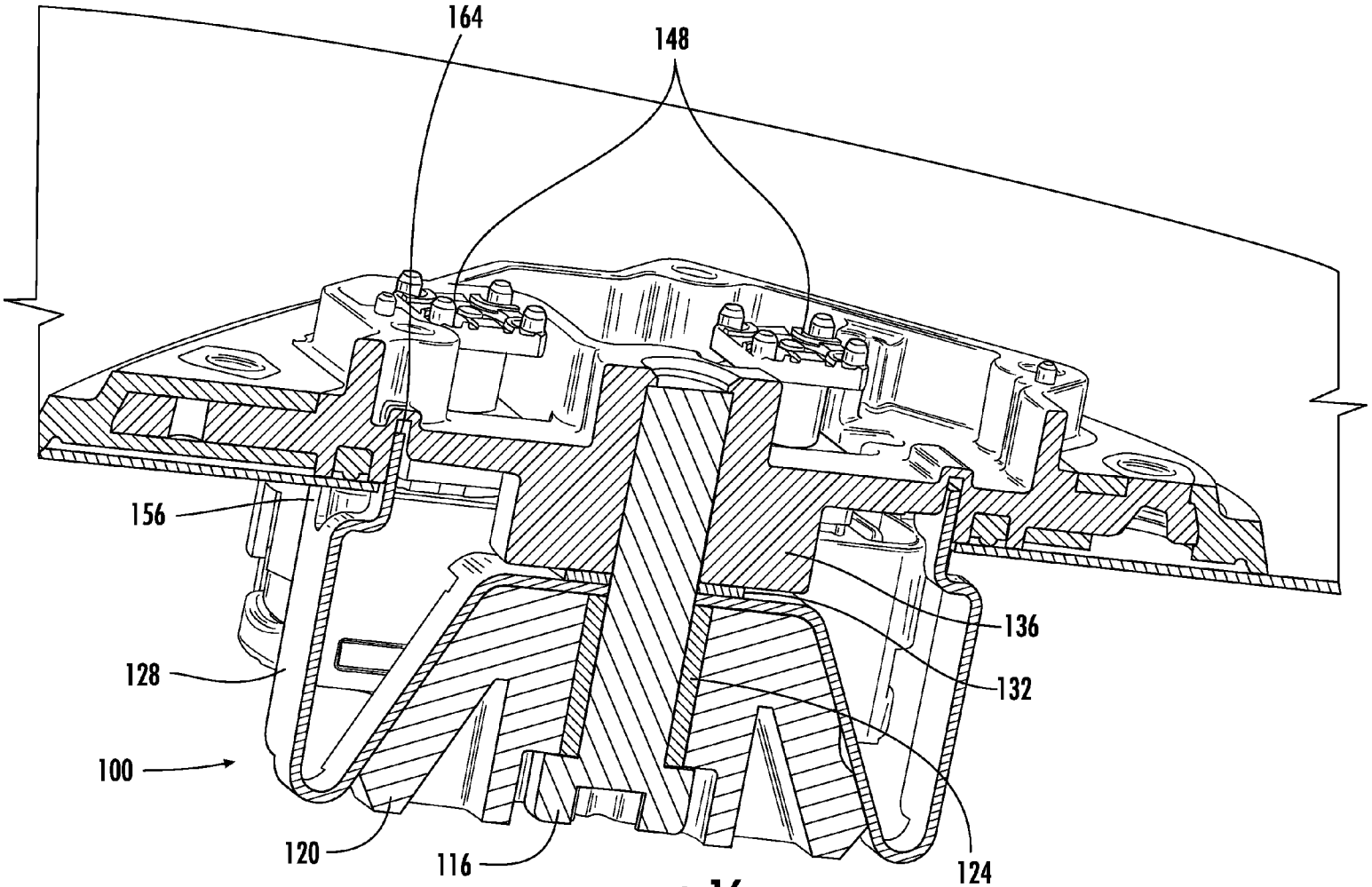
Figure 17:
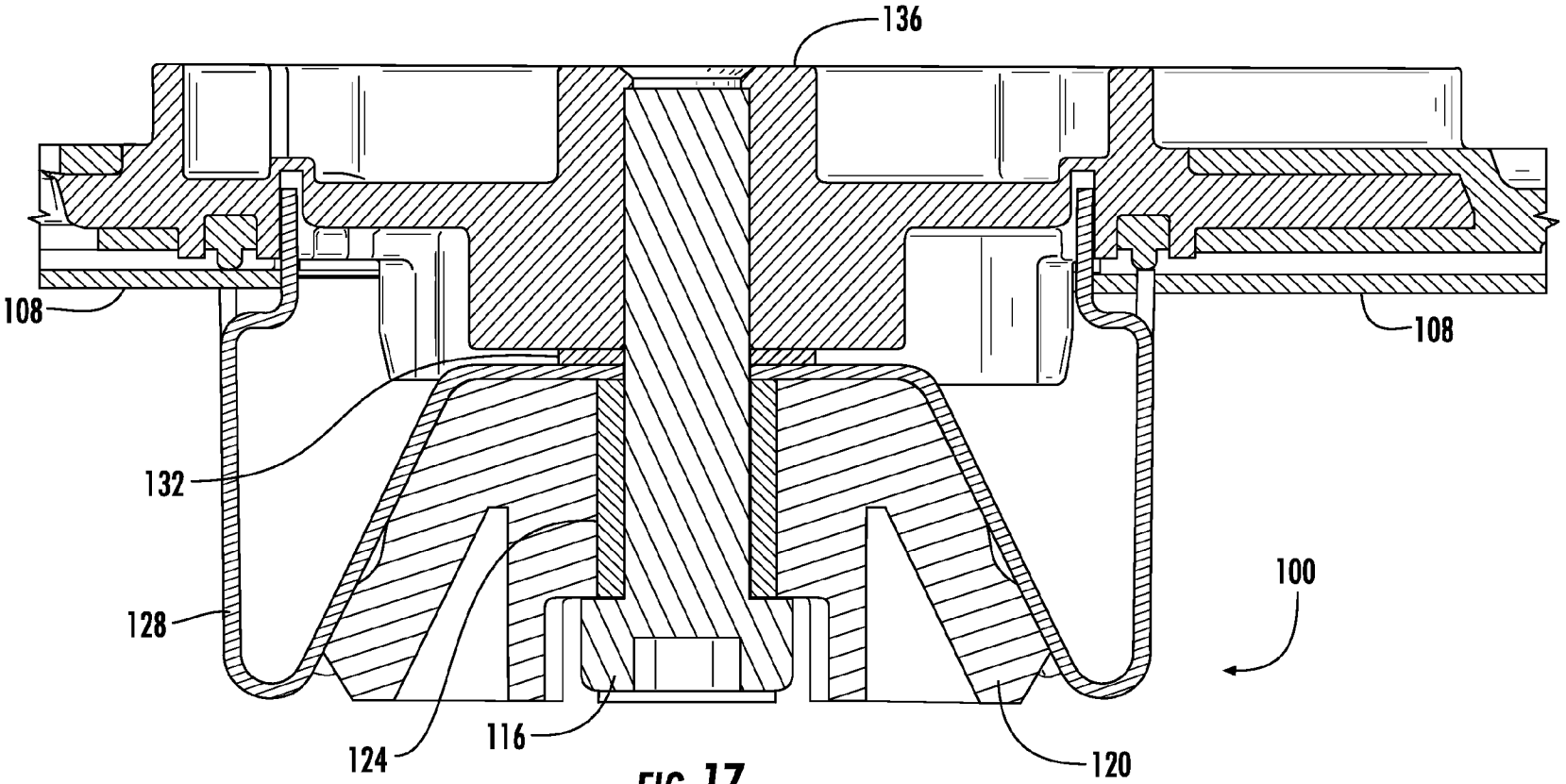
Figure 18:
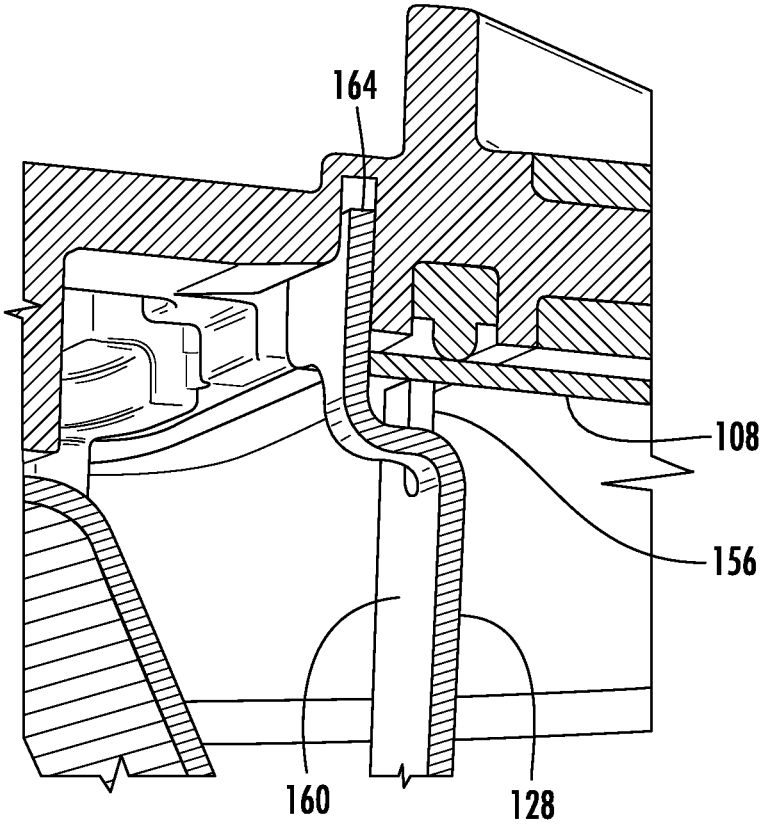
Figure 19:
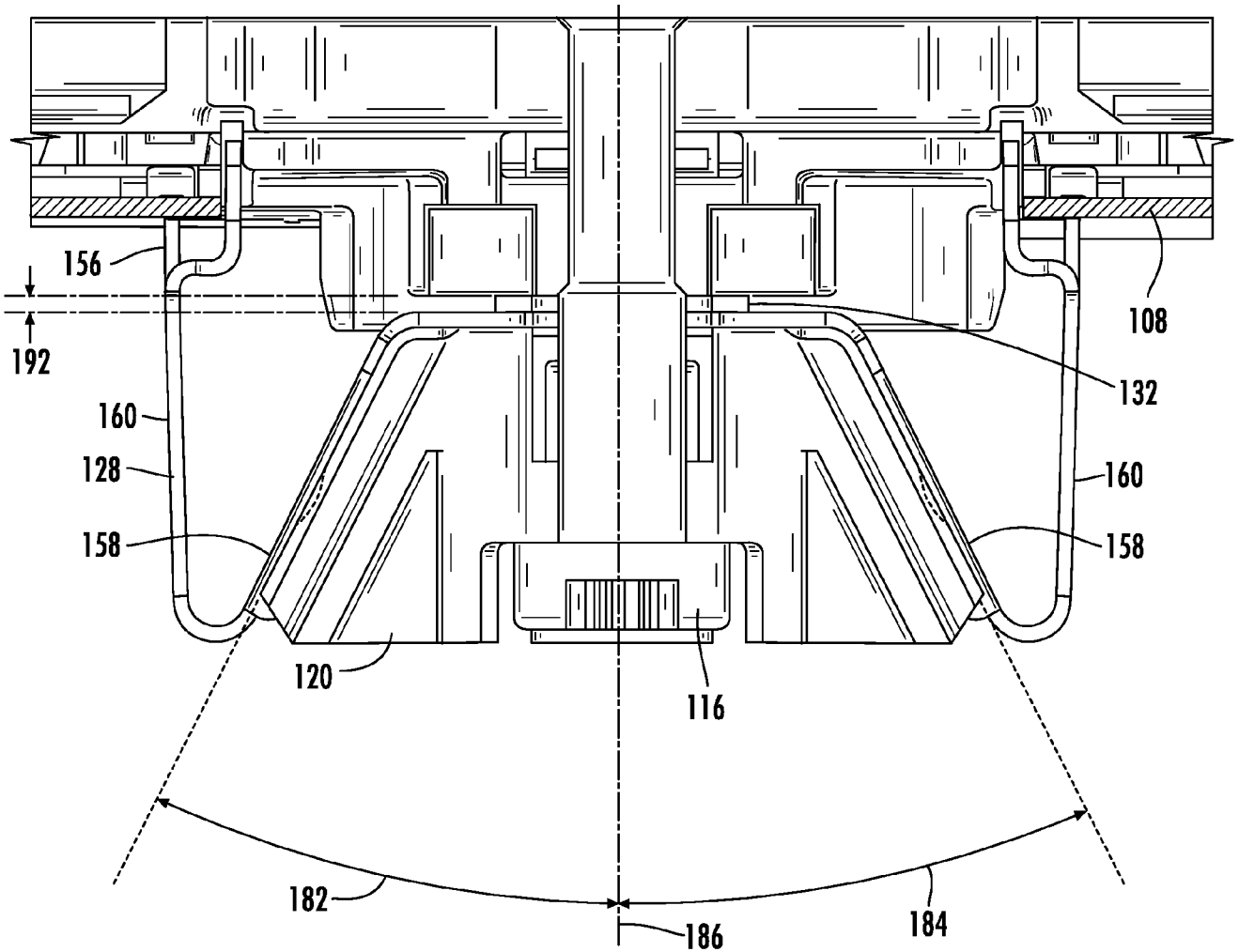
Figure 20:
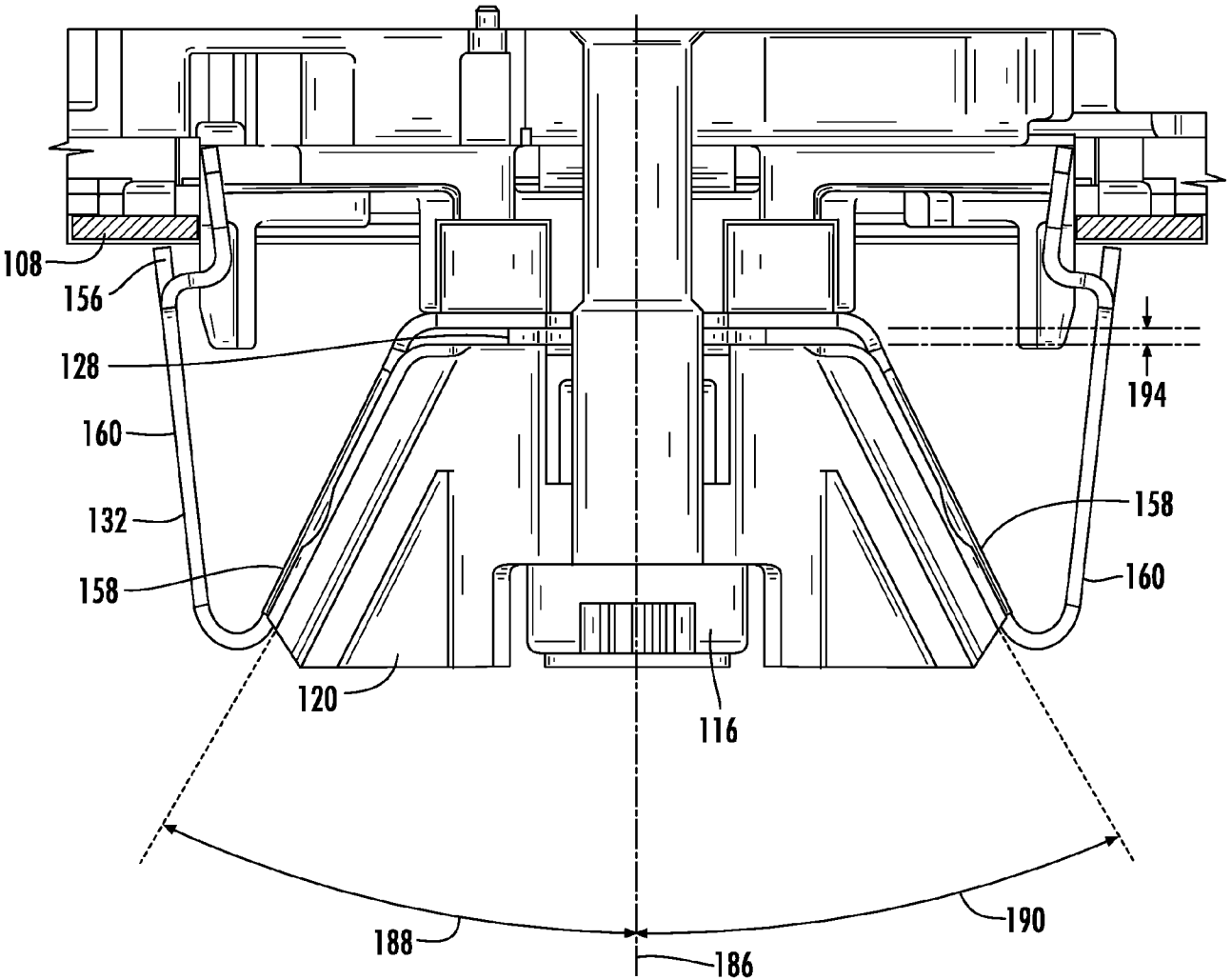
Figure 21:
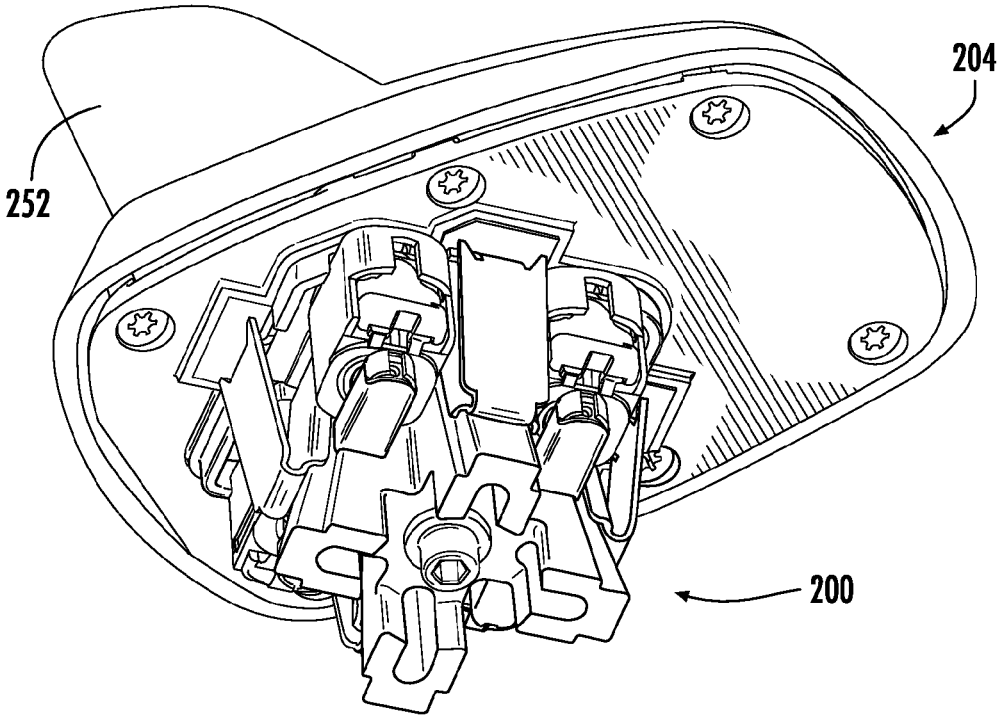

FIG. 13 is a perspective view of the antenna assembly shown in FIG. 2 and illustrating (from inside the vehicle) the antenna assembly mounted to the vehicle body wall, after the fastener, clamping piece, sleeve, and brackets have been at least partially inserted through the mounting hole in the vehicle body wall into an interior compartment side of a vehicle and the fastener has been rotated (as shown in FIGS. 3 and 8) by an installer from inside the vehicle;

FIG. 14 is a bottom view of the antenna assembly shown in FIG. 13;

FIGS. 15 and 16 are cross-sectional perspective view of the antenna assembly shown in FIG. 13, and illustrating the exemplary manner by which the fastener, sleeve, clamping piece, and brackets operate for applying a compressive clamping force to a vehicle body wall generally between grounding pins of the brackets and the antenna chassis;

FIG. 17 is a front partial cross-sectional view of the antenna assembly shown in FIGS. 15 and 16;

FIG. 18 is a partial cross-sectional view of the antenna assembly shown in FIGS. 15, 16, and 17 and illustrating the ground pin and extension of one of the brackets electrically coupled to the vehicle body wall and antenna chassis, respectively, according to an exemplary embodiment;

FIGS. 19 and 20 are partial cross-sectional view of the antenna assembly shown in FIG. 14, and illustrating the different angles at which the ground pins of one bracket contact the vehicle body wall as compared with the ground pins of the other bracket and also illustrating the different pressing/guiding angles between the clamping piece and brackets; and FIG. 21 is a lower perspective view of another exemplary embodiment in which an antenna assembly includes a fin and a fastener, clamping piece, sleeve, and brackets, which may be used for mounting the antenna assembly to a vehicle body wall.

Corresponding reference numerals indicate corresponding parts throughout the several views of the drawings.

DETAILED DESCRIPTION

Example embodiments will now be described more fully with reference to the accompanying drawings.

According to various aspects, exemplary embodiments are provided of antenna mounting apparatus or systems and methods relating to mounting antenna components, modules, assemblies, etc. to mounting surfaces, such as vehicle roofs, hoods, trunk lids, etc. Other aspects relate to antenna assemblies including the mounting apparatus or systems.

As disclosed herein, various exemplary embodiments generally include one or more electrically-conductive brackets (broadly, one or more contact parts), an electrically-conductive sleeve (broadly, a contact part), a clamping or forcing piece, and a fastener, such as a screw, threaded bolt, other mechanical fasteners, etc. As explained hereinafter, the brackets, sleeve, clamping piece, and fastener may be used for mounting an antenna assembly or module to a mounting surface, such as a vehicle body wall (e.g., a vehicle's roof, hood, trunk lid, etc.). During the installation process, a driving force (e.g., a rotational force, etc.) applied to the fastener is converted into a compressive clamping force applied to the mounting surface via the clamping piece and brackets.

In various exemplary embodiments, each bracket includes a base portion with V-shaped legs or arms depending therefrom. One or more extensions and one or more ground pins (broadly, one or more feet) are disposed at the end of the V-shaped legs. In operation, the legs may be elastically deformed such that the brackets may be reusable, For example, if an antenna assembly is removed for service and/or repair, then the same set of brackets may be reused for reinstalling the antenna assembly back to the mounting surface. In such embodiments, the brackets may be formed of a sufficiently elastic, resilient material such that when the clamping force is removed from the brackets, the resilient nature of the material out of which the brackets and/or legs are constructed allows the bracket legs to return to their initial unloaded positions. The material from which the brackets are constructed may be selected so that during use of the brackets, the yield point of the material is not reached and no permanent, plastic deformation of the material occurs.

Prior to installation of an antenna assembly to a vehicle body wall, the brackets, sleeve, clamping piece, and fastener may be coupled to the antenna assembly. For example, the fastener may be inserted through aligned openings in the clamping piece, sleeve, and brackets. Then, the fastener may be threadedly engaged into a correspondingly threaded portion (e.g., threaded hole, socket, etc.) of the antenna assembly. For example, the threaded portion may comprise a threaded insert or threaded member that is attached to the antenna chassis or base. Or, for example, the threaded portion may be integrally defined or formed by the antenna base. After the fastener is threaded into the threaded portion associated with the antenna assembly, the fastener captures and retains the clamping piece, sleeve, and brackets to the antenna assembly. This facilitates antenna installation since the fastener, clamping piece, sleeve, and brackets will not fall or drop out as the antenna assembly is being installed and allows the antenna assembly (including the fastener, clamping piece, sleeve, and brackets) to be positioned collectively as a single unit relative to the mounting hole. Plus, it is also not necessary for the installer to hold the antenna assembly with two hands during the assembly process. The complete antenna mounting system may be pre-assembled to the antenna assembly before the mounting process to the vehicle begins and before the antenna assembly is sent to the customer for installation to a vehicle. The mounting system includes the pre-assembly and pre-fixing components, which allow for a relatively quick fixation process of the antenna assembly to the vehicle body wall, without requiring any additional fastener elements or catch mechanisms.

At the pre-mounted stage, the sleeve may be positioned outside the clamping piece. But the sleeve may later be positioned within or inserted into the clamping piece during the installation or mounting procedure. In some embodiments, the clamping piece and the brackets are not directly connected to each other. Instead, the clamping piece and brackets contact each other but are in an unconnected relationship. This unconnected relationship allows the clamping piece to slide or move relative to the brackets. The fastener holds and retains the clamping piece, sleeve, and brackets to the antenna assembly. Without the fastener, the clamping piece, sleeve, and brackets would come apart in some embodiments.

With the fastener, clamping piece, sleeve, and brackets coupled to the antenna assembly, the antenna assembly may be mounted to a vehicle body wall as follows (e.g., on a production line at a manufacturer's production site, etc.). The antenna assembly may be positioned from outside the vehicle along an external side of a vehicle body wall (e.g., roof, trunk lid, etc.). The positioning of the antenna assembly also inserts the head of the fastener, clamping piece, sleeve, and brackets at least partially through a mounting hole in the vehicle body wall, such that the fastener's tool reception site (e.g., hexagonal opening on a head of the fastener, etc.) is accessible to an installer from inside the vehicle. In addition, the antenna assembly may be aligned to the vehicle body wall by way having the mounting hole and antenna chassis portion(s) shaped so as to interfit with each other, which may thus force the installer to align the antenna assembly with the mounting hole in a particular way or orientation, or else the antenna chassis portion(s) cannot be inserted into the mounting hole.

The antenna assembly may be nipped to the vehicle body wall from the interior compartment side by an installer using only one hand and a suitable tool (e.g., Allen wrench, screwdriver, etc.) to rotate or otherwise drive the fastener while the chassis of the antenna assembly is disposed on the external side of the vehicle body wall.

In various exemplary embodiments, the fastener is rotatable such that rotation of the fastener drives, forces, or causes the clamping piece to move toward the vehicle body wall in a direction generally perpendicular to the fastener's rotational movement. With continued movement of the clamping piece, the clamping piece's tapered surfaces bear against and force the bracket legs to move and elastically deform generally outwardly and downwardly toward the vehicle body wall. The elastic deformation of the bracket legs also cause the ground pins (or more broadly feet) to change from an unclamped position to a clamped position abutting against the interior side of the vehicle body wall with a sufficient compressive, contact force such that a clamping force is applied for mounting the antenna assembly to the vehicle body wall. The clamping force is applied to the vehicle body wall generally between and by the interaction of the ground pins on the interior side of the vehicle body wall and the antenna assembly's chassis on the external side of the vehicle body wall. In the unclamped position, the ground pins may be spaced-apart below the vehicle body wall, or the ground pins may be in contact with the vehicle body wall.

The ground pins may electrically couple with (e.g., galvanically contact, capacitively couple, establish electrical grounding contact with, etc.) the vehicle body wall in some embodiments. By way of example, some embodiments include a relatively short electrical grounding path formed between the vehicle body wall and a ground, metallization layer of a printed circuit board, an electrically-conductive chassis, or other electrically-conductive portion of the antenna assembly. This electrical grounding path may be formed at least partially by the electrical coupling (galvanic or capacitive coupling) of the brackets' ground pins with the interior side of the vehicle body wall and the electrical coupling (e.g., galvanic contact, capacitive coupling, etc.) of the brackets' extensions with the electrically-conductive portion of the antenna assembly on the external/exterior side of the vehicle body wall. This electrical grounding path may be relatively short and direct. A shorter electrical grounding path will generally have less resonance, which, in turn, may help improve antenna performance. In some embodiments, the bracket extensions may be configured (e.g., sufficiently long, etc.) to extend from the bracket's legs on the interior side of the mounting surface through the mounting hole to the external side of the mounting surface to galvanically or capacitively couple with the antenna chassis or other electrically-conductive portion of the antenna assembly.

In some embodiments, the ground pins (or more broadly, feet) may be configured (e.g., provided or formed with a sharp point, sharp edge, claw, etc.) to scratch the vehicle body wall when the bracket legs are being elastically deformed by the clamping piece and the ground pins are contacting, pressing against, or sliding along the vehicle body wall. In other embodiments, the ground pins may have a blunt bottom surface that still scratches the vehicle body wall when the ground pins contact or slide along the vehicle body wall, for example, due to the metal-to-metal contact and clamping force applied. The scratches may help provide good galvanic contact with the vehicle body wall, for example, by scratching off a lacquer coating on the vehicle body wall. By way of example, the ground pins may be configured such that their entire bottom surface is perpendicular to, flat, and flush against the vehicle body wall to thereby provide a larger area of contact between the ground pins and the vehicle body wall. Or, for example, the ground pins may be configured to contact the vehicle body wall at an slant or angle. As yet another example, the ground pins of one bracket may be configured to contact the vehicle body wall perpendicularly, while the ground pins of the other bracket are configured to contact the vehicle body wall at an slant or angle.

In some exemplary embodiments, the arms or legs of the brackets are configured (e.g., dimensionally sized and shaped relative to the mounting hole, etc.) such that the legs will not catch the edges of the mounting hole as the legs are inserted through the mounting hole. For example, if the mounting hole is relatively large in size, the bracket legs may be inserted through the mounting hole without being compressed or moved inwardly. In still other embodiments, the mounting hole may be small enough such that the outer portions/members of the bracket legs contact the edges of the mounting hole during insertion. This contact causes the outer portions of the bracket legs to compress or move inwardly during the insertion through the mounting hole. But the inner portions/members of the legs do not compress or move inwardly due at least partially to those inner portions being in contact with the clamping piece. Also, the base portions of the brackets also do not compress or move inwardly during the insertion through the mounting hole. After the legs clear the mounting hole, the outer portions of the brackets may then spring back and return to their initial, unloaded position. This also positions the ground pins outside the mounting hole such that the ground pins vertically align for contact with or overlay the interior compartment side of the vehicle body wall. Accordingly, the antenna assembly may thus be temporarily retained to the vehicle body wall within the mounting hole by way of the ground pins and the antenna chassis being disposed on opposite sides of the vehicle body wall and without any direct physical contact between the clamping piece and the vehicle body wall. This may prove advantageous, for example, when the mounting hole is in the trunk lid such that the antenna assembly won't fall out if an installer opens the trunk lid to access the fastener during the mounting process.

Depending on the particular application, the antenna assembly (to which the fastener, sleeve, clamping piece and brackets are attached) may include an antenna base or chassis configured to be disposed along an external side of the vehicle with respect to the vehicle body wall. The antenna assembly may also include a printed circuit board, which may be at least partially supported by the chassis. The printed circuit board may include a bottom metallization layer or ground. One or more electrical connectors (e.g., FAKRA connector, ISO (International Standards Organization) standard connector, etc.) may be electrically coupled to the printed circuit board. The one or more electrical connectors may extend through corresponding openings in the chassis, such the end portions of the electrical connectors extend through the mounting hole in the vehicle body wall and are accessible from inside the vehicle (as is the tool reception site of the fastener). Accordingly, the end portions of the electrical connectors are thus disposed on the interior compartment side of the vehicle, while the chassis and printed circuit board are disposed on the external side of the vehicle body wall. In these embodiments, an installer (from inside the vehicle) may thus electrically connect a coaxial cable (or other suitable communication link) to the ISO connector or FAKRA connector. The coaxial cable may be used for communicating signals received by the antenna assembly to another device, such as a radio receiver, display screen, and/or other suitable device. In such embodiments, the use of a standard type electrical connector (e.g., ISO connector, FAKRA connector, etc.) may allow for reduced costs as compared to those antenna installations that require a customized design and tooling for the electrical connection between the antenna assembly and electrical wiring. The pluggable electrical connections also allow for connection between a communication link and the antenna assembly's electrical connector without requiring the installer to route wiring, cabling, or pigtails through the mounting hole. The pluggable electrical connections may be easily accomplished without requiring any particular technical and/or skilled operations on the part of the installer. Other embodiments may include other types of electrical connectors, such as pigtails, etc.

The brackets may be configured so as to not experience permanent, plastic deformation during use. By way of example only, the brackets disclosed herein may be made of metal, alloy, or other suitable electrically-conductive material(s) that will not be permanently deformed due to the stress imparted thereon from the installation process.

Other aspects relate to methods of installing antenna modules, assemblies, or components to mounting surfaces, such as a vehicle body wall having external and internal sides with a mounting hole therebetween. In some exemplary embodiments, a method generally includes positioning an antenna assembly relative to a mounting hole from an external side of the vehicle body wall, such that the chassis of the antenna assembly is disposed along the external side of the vehicle body wall and such that the fastener, clamping piece, sleeve, brackets and one or more electrical connectors are accessible from the internal side of the vehicle body wall. The method may also include (from inside the vehicle) driving (e.g., rotating, etc.) the fastener (e.g., using an Allen or hex-head wrench, wrench, socket wrench, screwdriver, pliers, other suitable tool, etc.) to move the clamping piece to towards the vehicle body wall, for example, in a direction generally perpendicular to the fastener's rotational movement. The movement of the clamping piece causes the clamping piece's tapered outer surfaces to bear against and force the bracket legs to move and elastically deform generally outwardly and downwardly toward the vehicle body wall. The elastic deformation of the bracket legs also cause the ground pins to change from an unclamped position to a clamped position in which the ground pins abut against the interior side of the vehicle body wall with a sufficient compressive, contact force such that a clamping force is applied for mounting the antenna assembly to the vehicle body wall. The clamping force is applied to the vehicle body wall generally between and by the interaction of the ground pins on the interior side of the vehicle body wall and the antenna chassis base on the external side of the vehicle body wall. In the unclamped position, the ground pins may be spaced-apart below the vehicle body wall, or the ground pins may be in contact with the vehicle body wall. In addition to applying or transferring the clamping force for mounting the antenna assembly to the vehicle body wall, the ground pins may also electrically couple with the vehicle body wall.

Accordingly, exemplary embodiments of the present disclosure include antenna mounting apparatus or systems that may be used for mounting antenna components, modules, assemblies, etc. to mounting surfaces, such as vehicle roofs, hoods, trunk lids, etc. In various embodiments, the mounting apparatus or system is pre-mounted, such that no additional, separate parts are needed on the production line for mounting (and electrically grounding in some embodiments) the antenna assembly, module, or component, thus facilitating the mounting process on the production line. The clamping piece may be formed of plastic or metal. The fastener, sleeve, and brackets may be formed of metal or other electrically-conductive material. The clamping piece may provide the main force for fixation by elastically deforming the brackets and without applying the fixation force to coaxial cables associated with the antenna assembly.

Figure 1:
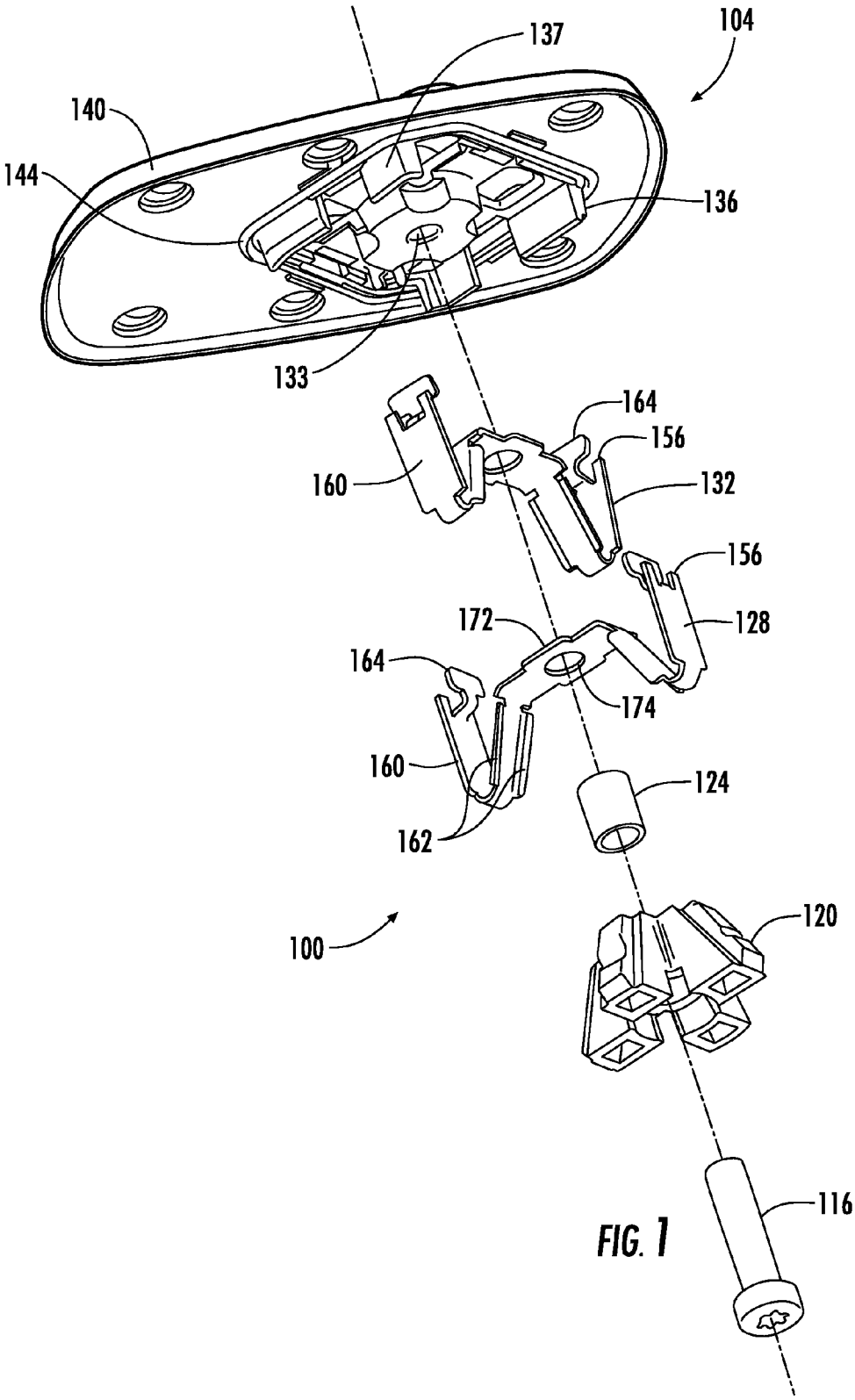
FIG. 1 is an exploded perspective view of an antenna assembly and illustrating a fastener, clamping piece, sleeve, and brackets, which may be used for mounting the antenna assembly to a vehicle body wall according to an exemplary embodiment of the present disclosure.

FIGS. 1 and 2 illustrate a vehicle antenna mounting apparatus or system 100 embodying one or more aspects of the present disclosure. As shown in FIG. 1, the mounting apparatus 100 generally includes a fastener, driving member, or tightening device 116 and a clamping or forcing piece 120. The mounting apparatus 100 also includes a sleeve 124 (broadly, a contact part), and first and second brackets or clips 128 and 132 (broadly, contact parts). As shown in FIG. 2, the mounting apparatus 100 may be used for mounting an antenna assembly 104 to a vehicle body wall 108 having a mounting hole 112.

Figure 4:
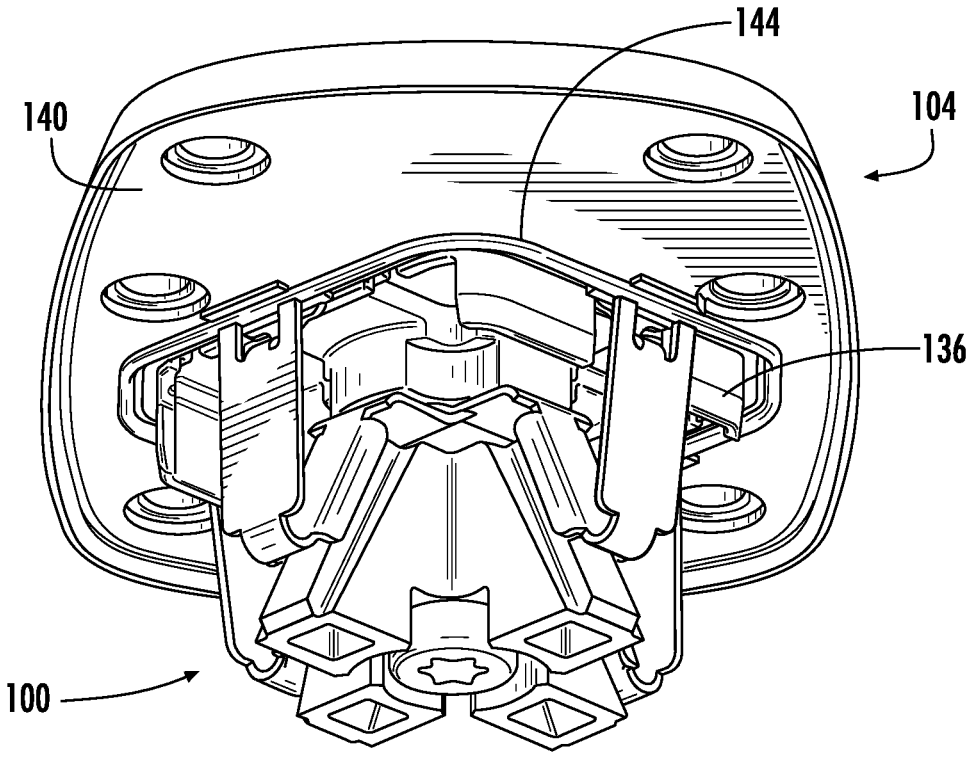
FIG. 4 is a lower perspective view of the antenna assembly shown in FIG. 2.
Figure 5:
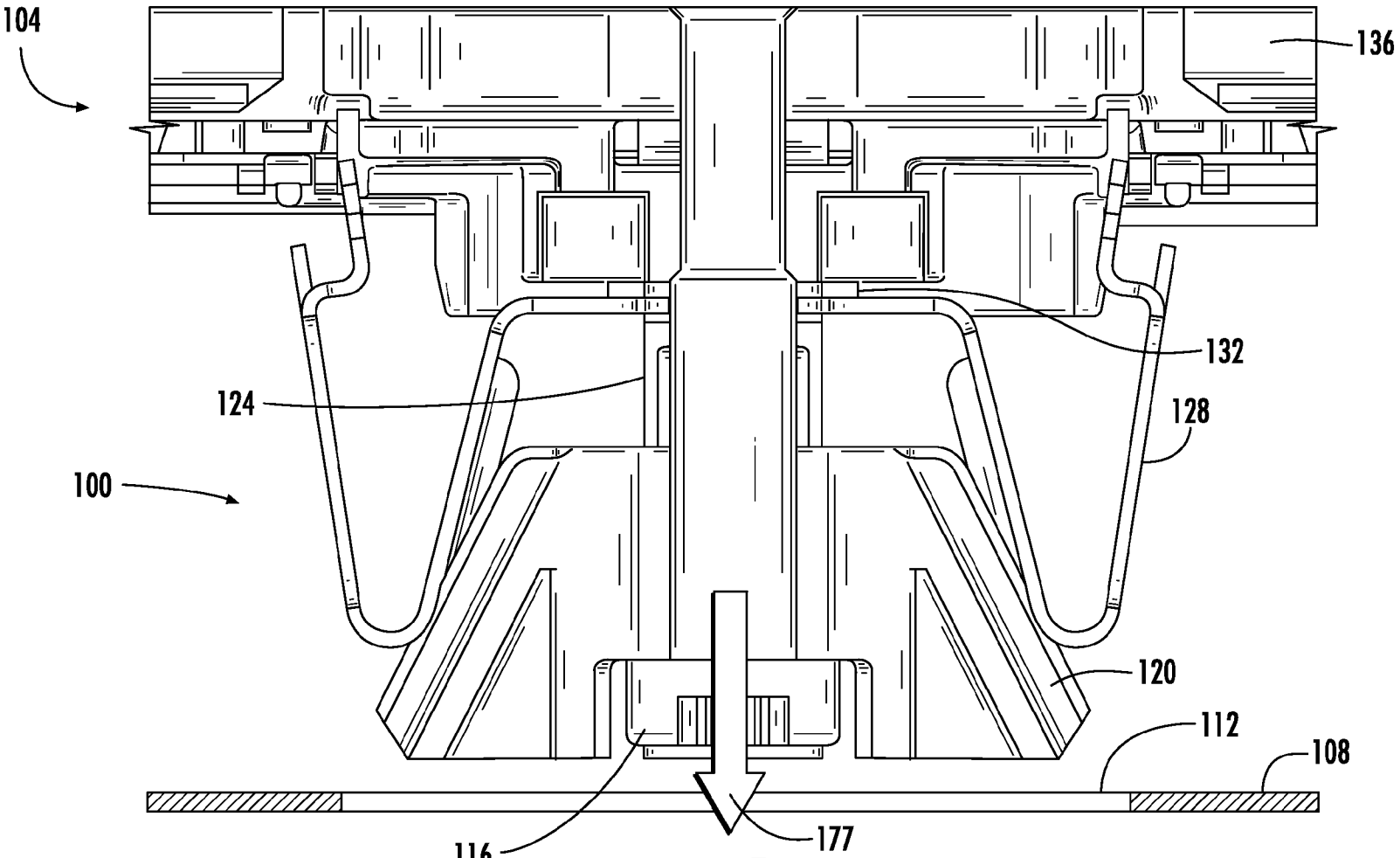
FIGS. 5 through 8 are partial cross-sectional views illustrating various stages during the mounting of the antenna assembly shown in FIGS. 1, 2, and 4 to a vehicle body wall.
Figure 9:
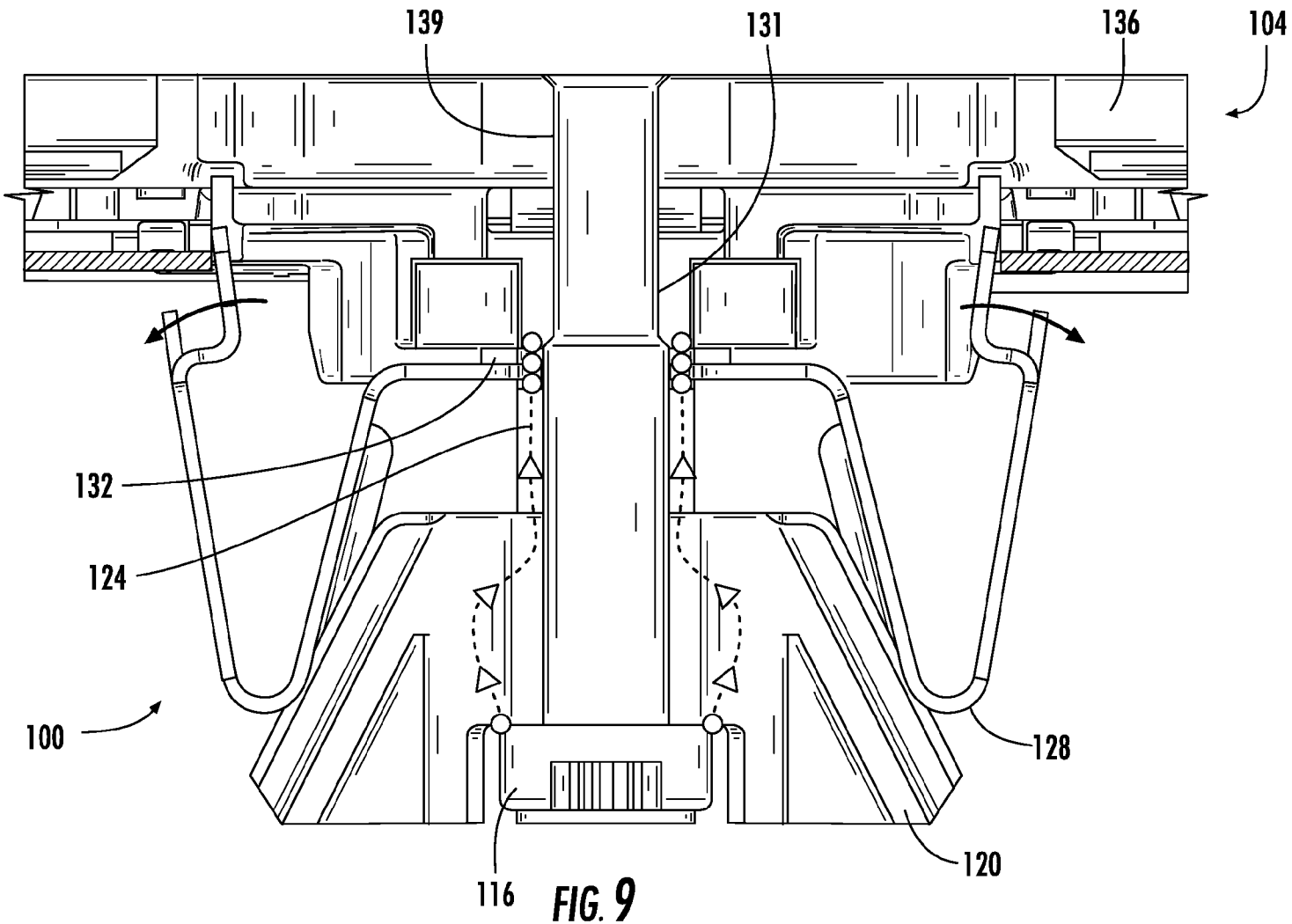
FIG. 9 is another cross-sectional view similar to FIG. 5 and illustrating the exemplary manner by which the clamping piece, sleeve, and brackets are retained to the antenna assembly by the fastener.
Figure 10:
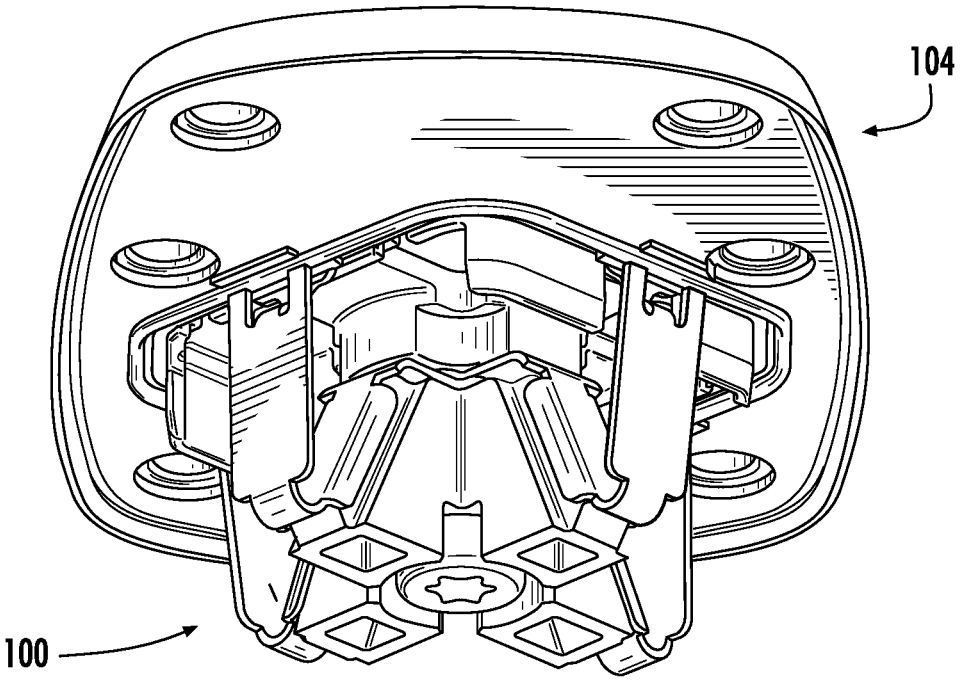
FIG. 10 is a lower perspective of the antenna assembly shown in FIG. 4 after the fastener has been rotated (as shown in FIGS. 3 and 8) to move the clamping piece and brackets into a clamping configuration for applying a compressive clamping force to a vehicle body wall.
Figure 11:
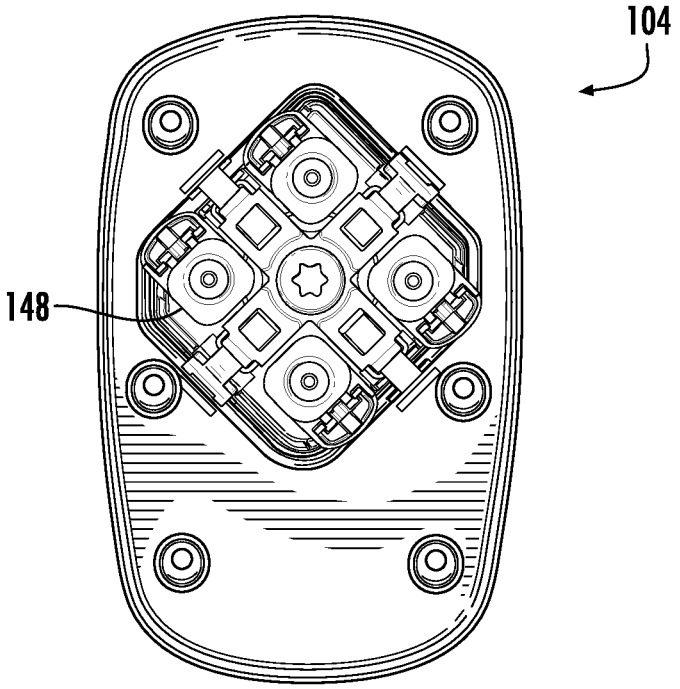
FIG. 11 is a bottom view of the antenna assembly shown in FIG. 10.
Figure 12:
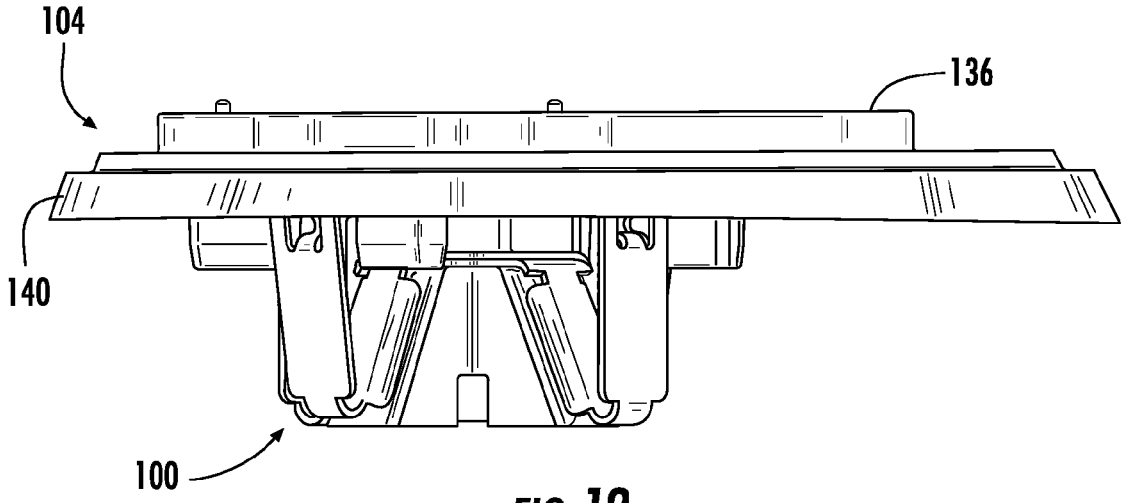
FIG. 12 is a side view of the antenna assembly shown in FIG. 10.

Prior to installation or mounting of the antenna assembly 104 to the vehicle body wall 108, the fastener 116, clamping piece 120, sleeve 124, and brackets 128, 132 may be coupled to the antenna assembly 104 as shown in FIGS. 3, 4, and 5. For example, the fastener 116 may be inserted through openings (FIG. 1) in the clamping piece 120, sleeve 124, and brackets 128, 132. Then, the fastener 116 may be threadedly engaged into a correspondingly threaded portion 133 (e.g., threaded hole, socket, etc.) of the antenna assembly 104. For example, the threaded portion 133 may comprise a threaded insert or threaded member that is attached to the antenna base 136. Or, for example, the threaded portion 133 may be integrally defined or formed by the antenna base 136. As shown in FIG. 9, the threaded portion 133 may include a pre-mounting threaded area 131 and a fixation threaded area 139. The fastener 116 is threadedly engaged with the pre-mounting threading area 131 prior to mounting the antenna assembly 116. But the fastener 116 is threaded into the fixation threaded area 139 while mounting the antenna assembly 104 to the vehicle body wall 108.

After the fastener 116 is threaded into the threaded portion 133 associated with the antenna assembly 104, the fastener 116 captures and retains the clamping piece 120, sleeve 124, and brackets 128, 132 to the antenna assembly 104. This facilitates antenna installation since the fastener 116, clamping piece 120, sleeve 124, and brackets 128, 132 will not fall or drop out as the antenna assembly 104 is being installed, such that it is not necessary for the installer to hold the antenna assembly 104 with two hands during the assembly process. This also means that the complete antenna mounting system 100 may be pre-assembled to the antenna assembly 104 before the mounting process to the vehicle begins and/or before the antenna assembly 104 is sent to the customer for installation to a vehicle. The mounting system 100 includes the pre-assembly and pre-fixing components which allow for a relatively quick fixation process of the antenna assembly to the vehicle body wall 108, without requiring any additional fastener elements or catch mechanisms.

At the pre-mounted stage shown in FIGS. 3 and 5, the sleeve 124 is not positioned entirely within the clamping piece 120. But while the antenna assembly 104 is being mounted, the sleeve 124 is pushed into or inserted into the clamping piece 120 as shown in FIG. 15.

With the fastener 116, clamping piece 120, sleeve 124, and brackets 128, 132 coupled to the antenna assembly 104, the antenna assembly 104 may be mounted to a vehicle body wall 108 (e.g., on a production line at a car manufacturer's production site, etc.) as follows. The antenna assembly 104 may be positioned from outside the vehicle along an external side of the vehicle body wall 108. The positioning of the antenna assembly 104 also at least partially inserts (as represented by the vertical 177 arrows in FIGS. 5 and 6) the head of the fastener 116, clamping piece 120, sleeve 124, and brackets 128, 132 through the mounting hole 112 in the vehicle body wall 108 (FIG. 7).

Figure 6:
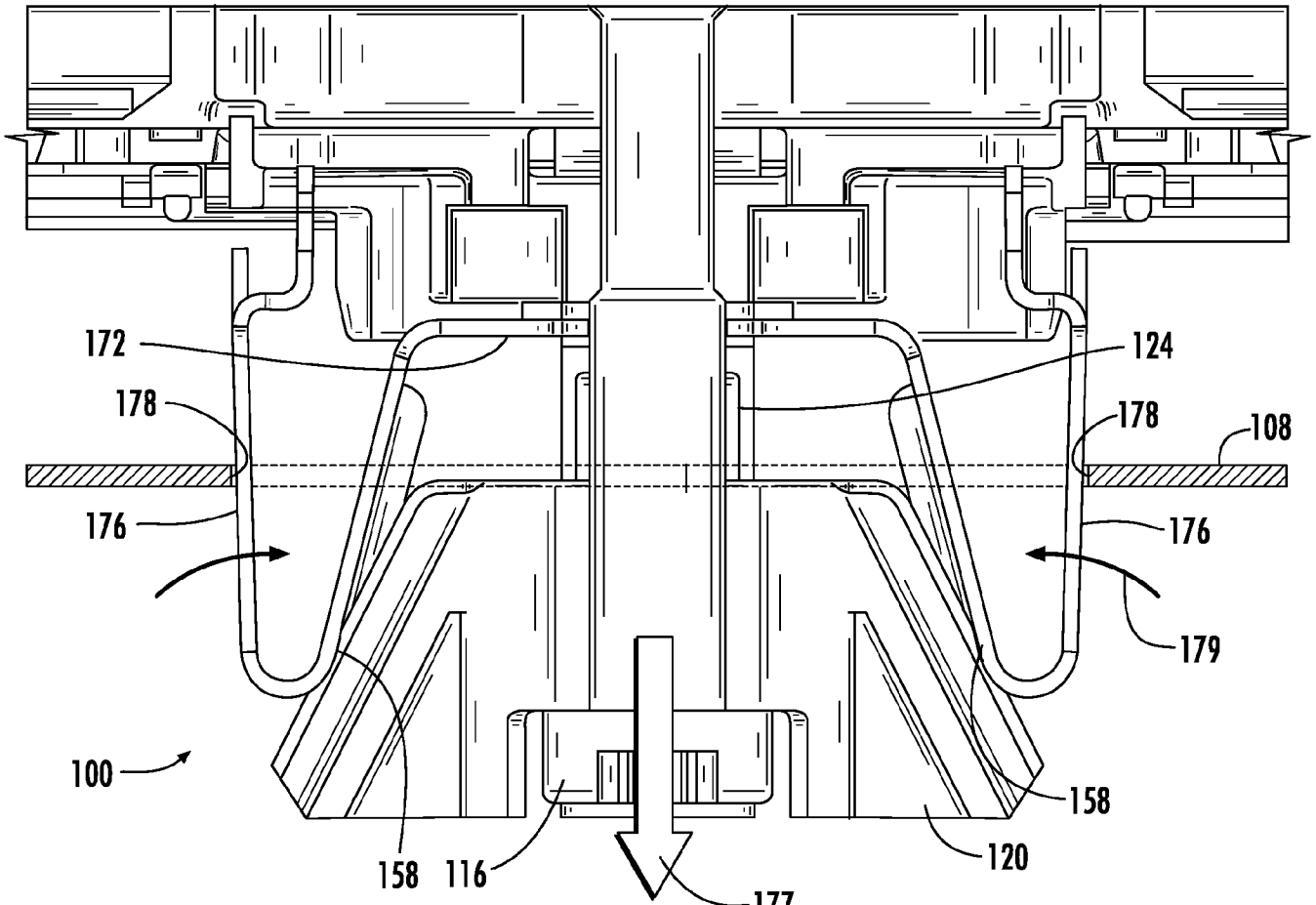
Figure 7:
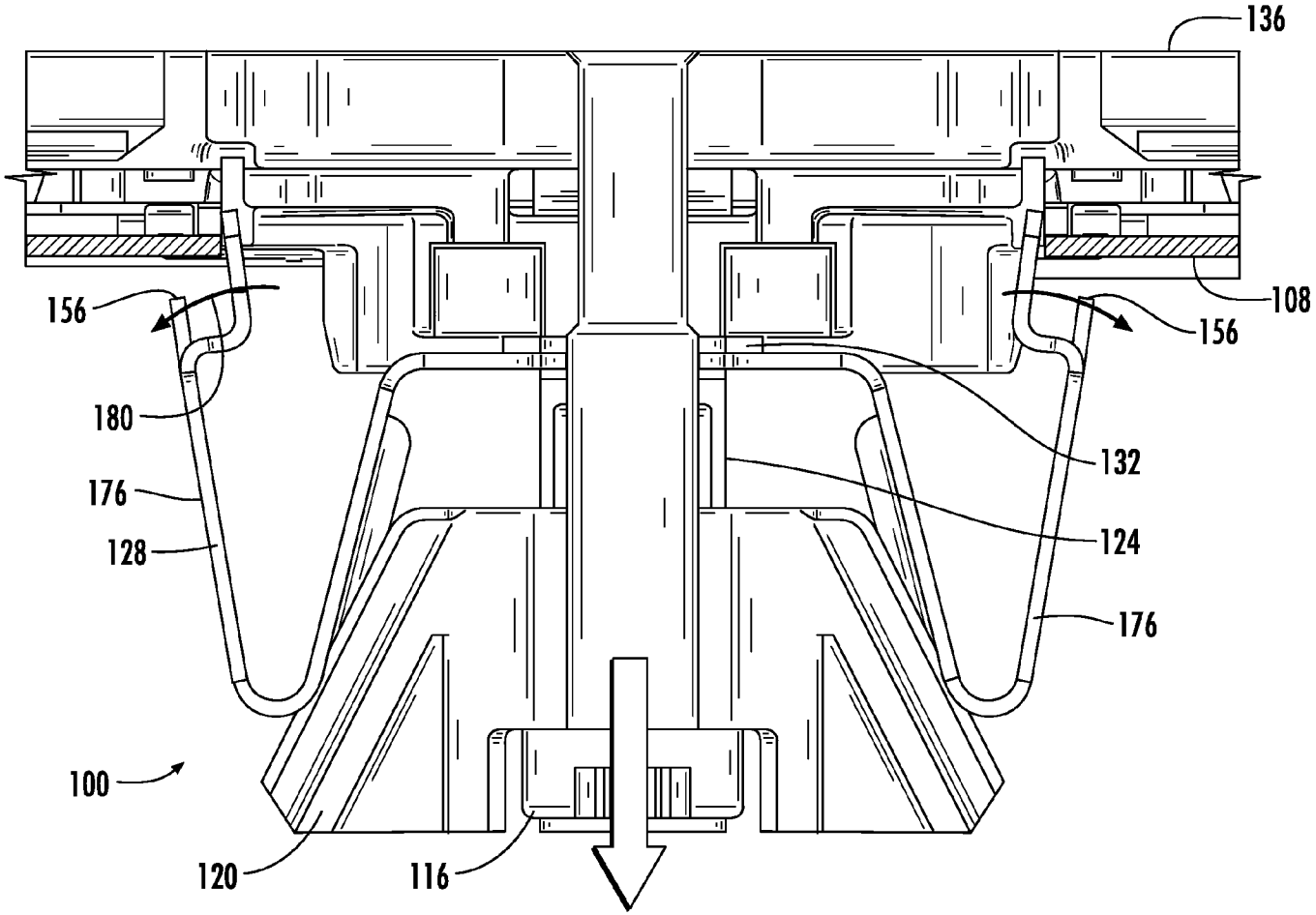

With further reference to FIGS. 5, 6, and 7, the mounting hole 112 may be small enough relative to the width of the brackets 128, 132 (FIG. 5) such that the outer portions 176 (FIG. 6) of the brackets 128, 132 contact the edges 178 of the mounting hole 112 during insertion. This contact causes the outer portions 176 of the brackets 128, 132 to move or pivot inwardly (as represented by the inwardly facing curved arrows 179 in FIG. 6) during the insertion through the mounting hole 112. The inner portions or members 158 of the brackets 128, 132 do not compress or move inwardly due at least partially to those inner portions 159 being in contact with the clamping piece 120. Also, the middle or base portions 172 of the brackets 128, 132 also do not compress or move inwardly during the insertion through the mounting hole 112. After the legs or arms 160 of the brackets 128, 132 clear the mounting hole 112, the outer portions or members 176 of the brackets 128, 132 may then spring back (as represented by the outwardly facing curved arrows 180 in FIG. 7) and return to their initial, unloaded position. This also positions the ground pins 156 (more broadly, feet) outside the mounting hole 112 such that the ground pins 156 align for contact with the interior compartment side of the vehicle body wall 108. Accordingly, FIG. 7 illustrates the antenna assembly 104 being temporarily retained to the vehicle body wall 108 by way of the ground pins 156 and the antenna chassis 136 base being disposed on opposite sides of the vehicle body wall 108 and without any direct physical contact between clamping piece 120 and the vehicle body wall 108.

This insertion process may also align the antenna assembly 104 to the vehicle body wall 108. For example, the mounting hole 112 and antenna chassis portions 137 (FIG. 1) may be shaped complementary so as to interfit with each other. The antenna chassis portions 137 and mounting hole 112 may be shaped such that the antenna assembly 104 must be aligned in a particular way or orientation relative to the mounting hole 112 or the installer won't be able to insert the antenna chassis portions 137 into or through the mounting hole 112.

After the insertion process (FIGS. 5, 6, and 7), the fastener's tool reception site (e.g., star-shaped or hexagonal opening in the head of the fastener 116, etc.) is accessible to an installer from inside the vehicle. This allows the antenna assembly 104 to be nipped to the vehicle body wall 108 from the interior compartment side by an installer using only one hand and a suitable tool (e.g., Allen wrench, etc.) to rotate the fastener 116 (as represented by the arrow in FIG. 8) from inside the vehicle.

With this rotation of the fastener 116, a compressive clamping force is applied to the vehicle body wall 108 generally between the grounding pins 156 of the brackets 128, 132 and the antenna chassis 136. With reference to FIG. 3, the rotation of the fastener 116 drives, forces, or otherwise causes the clamping piece 120 to move toward the vehicle body wall 108, which movement is generally perpendicular to the rotation movement of the fastener 116.

Flanges 162 extend outwardly from the inner surfaces 158 of the bracket legs 160. These flanges 162 help guide the clamping piece 120 as the clamping piece 120 is moved along and against the inner surfaces 158 of the bracket legs 160 during the fastener 116 rotating process. Additionally, or alternatively, the flanges 162 may facilitate the alignment of the clamping piece 120 with the brackets 128, 132. In any event, the clamping piece's tapered surfaces 162 (as they move toward the vehicle body wall 108) slide along and bear against the bracket legs 160, which force the bracket legs 160 to move and elastically deform generally outwardly and downwardly toward the vehicle body wall 108. Accordingly, the clamping piece 120 in this example thus provides the main force for fixation by elastically deforming the brackets 128, 132.

The movement of the clamping piece 120 also repositions, pushes, or inserts the sleeve 124 into an open or hollow area of the clamping piece 120. After which, the clamping piece 120 and sleeve 124 may then be adjusted and moved together.

The elastic deformation of the bracket legs 160 also move the ground pins 156 toward the vehicle body wall 108, from an unclamped position to a clamped position (shown in broken lines). In the clamped position, the ground pins 156 abut against the interior side of the vehicle body wall 108 with a sufficient contact force such that a clamping force is applied for mounting the antenna assembly 104 to the vehicle body wall 108. The clamping force is applied to the vehicle body wall 108 generally between and by the interaction of the ground pins 156 on the interior side of the vehicle body wall 108 and the antenna chassis 136 on the external side of the vehicle body wall 108. In the unclamped position, the ground pins 156 may be in contact with or be spaced-apart from the vehicle body wall 108.

In this illustrated embodiment, the clamping piece 120 and the brackets 128, 132 are not directly connected to each other. Instead, the clamping piece 120 and brackets 128, 132 contact each other but are in an otherwise unconnected relationship. This unconnected relationship allows the clamping piece 120 to slide or move relative to the brackets 128, 132. The fastener 116 holds and retains the clamping piece 120, sleeve 124, and brackets 128, 132 to the antenna assembly 104. Without the fastener 116, the clamping piece 120, sleeve 124, and brackets 128, 132 would come apart in some embodiments. To this end, FIG. 9 illustrates the exemplary manner by which the mounting apparatus 100 is retained to the antenna assembly 104 by the fastener 116. As shown, the clamping force or pressure starts at the head of the fastener 116. The clamping force travels or transfers through the clamping piece 120 to the sleeve 124, as represented by the broken arrows. The sleeve 124 pushes against and applies a force to the bracket 128 as represented by the first dot. The bracket 128 pushes against and applies a force to the bracket 132, as represented by the second dot. The bracket 132 contacts the antenna chassis 116, as represented by the third dot. FIG. 9 also illustrates the pre-mounting threaded area 131 and the fixation threaded area 139. The fastener 116 is threadedly engaged with the threading area 131 prior to mounting the antenna assembly 116. But the fastener 116 is threaded into the fixation threaded area 139 while mounting the antenna assembly 104 to the vehicle body wall 108.

FIGS. 13 and 14 illustrate the antenna assembly 104 mounted to the vehicle body wall 108, after the fastener 116, clamping piece 120, sleeve 124, and brackets 128, 132 have been at least partially inserted through the mounting hole 112 in the vehicle body wall 108 into an interior compartment side of a vehicle, and the fastener 116 has been rotated (as shown in FIG. 3) by an installer from inside the vehicle. FIGS. 15, 16, and 17 illustrate the exemplary manner by which the fastener 116, clamping piece 120, sleeve 124, and brackets 128, 132 operate for applying a compressive clamping force to the vehicle body wall 108 generally between the bracket grounding pins 156 and the antenna chassis 136.

The ground pins 156 may also help establish electrical grounding contact with the vehicle body wall 108 in some embodiments. As shown in FIG. 18, a relatively short, direct electrical grounding path is formed from the antenna chassis to the vehicle body wall 108 by the electrical coupling (galvanic or capacitive) of the brackets' ground pins 156 with the interior side of the vehicle body wall 108 and the electrical coupling (galvanic or capacitive) of the brackets' extensions 164 with the antenna chassis 136, which is on the exterior side of the vehicle body wall 108. This electrical grounding path is relatively short. A shorter, more direct electrical grounding path may generally have less resonance than a longer electrical path, which, in turn, may improve antenna performance. As shown in FIG. 13, the bracket extension 164 is configured (e.g., sufficiently long, etc.) to extend from the bracket's leg 160 on the interior side of the vehicle body wall 108 through the mounting hole to the external side of the vehicle body wall 108 to galvanically contact or capacitively couple with the antenna chassis 136 on the opposite, external side of the vehicle body wall 108. In some embodiments, the brackets' ground pins 156 galvanically contact the interior side of the vehicle body wall 108, and the brackets' extensions 164 galvanically contact the antenna chassis 136. In other embodiments, there may be sufficient isolation (e.g., a gap or spaced distance, dielectric material, etc.) between one or more of the ground pins 156 and the interior side of the vehicle body wall 108 and/or between one or more of the extensions 164 and the antenna chassis 136 such that there is capacitive coupling without any direct galvanic connection.

The electrical grounding path from the vehicle body wall 108 to the antenna chassis 136, ground or other electrically-conductive portion of the antenna assembly 104 may also include the brackets' legs 160 and fastener 116. The fastener 116 may be galvanically or capacitively coupled to the antenna chassis 136 or other electrically-conductive portion of the antenna assembly 104.

In some embodiments, the ground pins 156 may also scratch, remove, or otherwise destroy a lacquer or other coating on the vehicle body wall 108 when the ground pins 156 are in contact with, pressing against, or slide along the vehicle body wall 108. The ground pins 156 may be configured (e.g., provided or formed with a sharp point, sharp edge, claw, etc.) to scratch the vehicle body wall 108. In other embodiments, the ground pins 156 may have a blunt bottom surface that still scratches the vehicle body wall 108 when the ground pins 156 contact or slide along the vehicle body wall 108, for example, due to the metal-to-metal contact and clamping force applied. The ground pins 156 of both brackets 128, 132 may be configured such that their entire bottom surface is perpendicular to, flat, and flush against the vehicle body wall 108 to thereby provide a larger area of contact between the ground pins 156 and the vehicle body wall 108. Or, for example, the ground pins 156 of both brackets 128, 132 may be configured to contact the vehicle body wall 108 at an slant or angle. As yet another example, the ground pins 156 of one bracket 128 or 132 may be configured to contact the vehicle body wall 108 at an angle different than the angle at which the ground pins 156 of the other bracket 132 contact the vehicle body wall 108. In the illustrated embodiment of FIGS. 19 and 20, the ground pins 156 of bracket 128 (FIG. 19) contact the vehicle body wall 108 perpendicularly, while the ground pins 156 of the bracket 132 (FIG. 20) contact the vehicle body wall 108 at a slant or angle. In this example, the ground pins 156 of bracket 128 (FIG. 19) may obtain electrical grounding or galvanic contact with the vehicle body wall 108 by pressing and some scratching. The ground pins 156 of bracket 132 (FIG. 20) may obtain electrical grounding or galvanic contact with the vehicle body wall 108 also by pressing and scratching. But due to the slanted, steeper contact angle between the ground pins 156 of bracket 132 and the vehicle body wall 108, the ground pins 156 of bracket 132 may scratch the wall 108 more than the ground pins 156 of the bracket 128 scratch the wall 108.

With continued reference to FIGS. 19 and 20, the clamping piece 120 is configured such that the pressing/guiding angles between the clamping piece 120 and the bracket 128 (FIG. 19) are different than the pressing/guiding angles between the clamping piece 120 and the bracket 132 (FIG. 20). In this particular embodiment, each of the two pressing/guiding angles 182, 184 (FIG. 19) is 63.5 degrees as measured from the centerline 186 to the inner portions 158 of the legs 160 of the bracket 128. By comparison, each of the two pressing/guiding angles 188, 190 (FIG. 20) is 67 degrees as measured from the centerline 186 to the inner portions 158 of the legs 160 of the bracket 132. Advantageously, the different pressing/guiding angles accommodate for the thickness 192 (FIG. 19), 194 (FIG. 20) of the material from which the brackets 128, 132 are made. This, in turn, allows for the use of identical (or substantially identical) brackets 128, 132 with the same (or approximately the same) pressing or contact force being generated between the ground pins 156 of the brackets 128, 132 and the vehicle body wall 108. The dimensions or angular measurements in this paragraph (as are all dimensions and angular measurements herein) are provided for purposes of illustration only as the specific dimensions or angular measurements for a particular application may vary, depending, for example, on the particular material thickness used for the brackets, the shape of the brackets and/or clamping piece, etc.

The fastener 116 may comprise a wide range of suitable mechanical fasteners, driving members, tightening devices, etc. By way of example, the fastener 116 may comprise a threaded bolt, threaded screw, other mechanical fastener, etc. In yet other embodiments, the fastener 116 may not include threads, but may instead be provided with other suitable means for engaging the antenna base. Also, the fastener 116 may be made from a wide range of materials, such as a metal, an alloy, other electrically-conductive material, etc. . . .

The clamping piece 120 may comprise a wide range of materials, such as plastic, metal, an alloy, etc. The sleeve 124 may also comprise a wide range of materials, such as a metal, an alloy, other electrically-conductive material, etc.

The brackets 128, 132 may comprise a wide range of materials, such as a metal, an alloy, other electrically-conductive material, etc. The material from which the brackets 128, 132 are constructed may preferably be selected so that during use of the brackets 128, 132, the yield point of the material is not reached and no permanent, plastic deformation of the material occurs. The materials provided herein for purposes of illustration only as the specific materials used in a particular embodiment may vary.

As shown in FIG. 1, each bracket 128, 132 includes a relatively flat base or middle portion 172 having an opening 174 therethrough. Each bracket 128, 132 also includes V-shaped legs or arms 160 connected to the base 172. Feet 156 and extensions 164 are disposed at the end of the V-shaped legs 160. In operation, the legs 160 are elastically deformed such that the brackets 128, 132 are reusable. For example, if the antenna assembly 104 needs to be removed from the vehicle body wall 108 for service and/or repair, the antenna assembly 104 may be reinstalled back to the vehicle body wall 108 using the same set of brackets 128, 132. In such embodiments, the brackets 128, 132 may be formed of a sufficiently elastic and resilient material such that when the clamping force applied to the brackets 128, 132 via the clamping piece 120 is removed from the brackets 128, 132, the resilient nature of the material out of which the brackets 128, 132 are constructed allows the bracket legs 160 to return to their initial unloaded positions.

As disclosed herein, the mounting apparatus 100 includes two identical brackets 128, 132, which have legs or arms 160 shaped, bent, formed, etc. to have a generally V-shaped profile. The brackets 128, 132 are positioned or stacked on each other at a ninety degree angle relative to each other as shown in FIG. 1. For each bracket 128, 132, the inner angle between the base 172 and the inner leg portions 158 and the outer angle between the inner and outer leg portions 158 and 176 change when the legs 160 are elastically deformed. As shown by FIG. 3, the inner angle increases and becomes more flat, while the outer angle decreases and becomes steeper in this illustrated embodiment.

Alternative embodiments may include more or less than two brackets and/or brackets configured differently (e.g., having more or less than two legs, having legs shaped differently, etc.). For example, another embodiment may include a single bracket having four legs instead of the pair of two-legged brackets 128, 132. Still other embodiments may include two or more brackets where at least one bracket is not identical to another bracket.

As shown by FIG. 17, the mounting apparatus 100 is configured such that there is direct physical contact (e.g., metal-to-metal contact, etc.) between the sleeve 124 and the bracket 128, between the sleeve 124 and the head of the fastener 116, and between the brackets 128, 132 and the fastener 116 (e.g., die cast screw dome, etc.) after the antenna assembly 104 is mounted. Prior to mounting, the sleeve 124 is disposed generally between the clamping piece 120 and the bracket 128 such that the sleeve 124 is at least partially outside the clamping piece 120 as shown by FIGS. 3 and 5. The rotation of the fastener 116 moves the clamping piece 120 which movement repositions the sleeve 124 at least partially within the clamping piece 120 and also causes the sleeve 124 to be compressively disposed or sandwiched between and in direct physical contact with the head of the fastener 116 and the base portion 172 of the bracket 128. Accordingly, in this example, this metal-to-metal contact is not affected by flowing of plastic material.

The illustrated antenna assembly 104 includes the chassis, base, or body 136 (e.g., die cast chassis, etc.), an overmoulding 140, a seal 144, and four electrical connectors 148 (FIG. 6). The connectors 148 are configured to be positioned through corresponding openings in the chassis 136, such that they are accessible from inside the vehicle. The electrical connectors 148 may be male or female connector portions configured for making a pluggable electrical connection with a corresponding male or female connector portion disposed at an end of the at least one communication link. By way of example, the electrical connectors 148 may be associated with Satellite Digital Audio Radio Services (SDARS), Global Positioning System (GPS), Global System for Mobile Communication (GSM), etc. In the illustrated embodiment, the connectors 148 are FAKRA connectors, which are designed as coaxial connectors comprising a dielectric and an outer conductor around an inner conductor. Alternative embodiments may include more or less than four connectors and/or different connectors besides FAKRA connectors, such as one or more ISO (International Standards Organization) standard electrical connector, pigtails, etc. depending, for example, on the particular vehicle and/or application intended for the antenna assembly 104.

The particular illustrated antenna assembly 104 is but a mere example that may be used in conjunction with a mounting apparatus (e.g., 100, etc.) disclosed herein. For example, the mounting apparatus 100 may be used for mounting other antenna assemblies, modules, and/or components, such as an antenna assembly having a printed circuit board and one or more antenna elements, such as one or more vertically extending antenna masts, one or more patch antennas, one or more radiating antenna elements (e.g., traces) on the printed circuit board, one or more planar inverted F-antenna (PIFA) elements, etc. disposed within an outer cover (e.g., a fin-shaped cover, etc.). As another example, FIG. 14 illustrates an exemplary antenna assembly 204 that may be mounted to a vehicle body wall with a mounting apparatus 200. In this illustrated example, the antenna assembly 204 has a fin-shaped cover or housing 252 in which may be disposed an FM/AM vertically-extending mast antenna, etc.

In addition, some aspects of the present disclosure relate to the mounting apparatus or systems. But other aspects relate to antenna assemblies including the mounting apparatus or systems.

Embodiments and aspects of the present disclosure may be used in a wide range of applications, such as antenna assemblies having patch antennas, telematics antennas, antennas configured for receiving satellite signals (e.g., Satellite Digital Audio Radio Services (SDARS), Global Positioning System (GPS), cellular signals, etc.), antennas configured for receiving RF energy or radio transmissions (e.g., AM/FM radio signals, etc.), antennas or receivers/transceiver configured for use with signals associated with one or more of WiFi, WiMax, DSRC (Dedicated Short Range Communications), etc., combinations thereof, among other signals communicated between antennas, receivers/transceivers, etc.

Embodiments and aspects of the present disclosure may be used for mounting various antenna assemblies, modules, and components to a wide range of mounting surfaces, including stationary platforms and mobile platforms. For example, a mounting apparatus disclosed herein may be used for mounting an antenna assembly to a surface of a bus, train, aircraft, among other mobile platforms, as well as to stationary platforms. Accordingly, the specific references to vehicle herein should not be construed as limiting the scope of the present disclosure to any specific type of supporting structure or environment.

In addition, the vehicle body wall 108 and mounting hole 112 are also but mere examples that may be used in conjunction with a mounting apparatus (e.g., 100, etc.) disclosed herein. For example, alternative embodiments may be used with mounting holes having different configurations, different sizes, different shapes (e.g., hexagonal mounting hole, non-rectangular mounting hole, etc.), etc. The particular configuration of mounting hole may depend, for example, on the particular features of the antenna assembly to be installed, such as the number and type of electrical connectors, etc.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An apparatus for mounting an antenna assembly having a chassis to a mounting surface having an external side, an interior side, and a mounting hole therebetween, the apparatus comprising:

one or more contact parts including one or more elastically deformable legs having one or more extensions and one or more feet;

a clamping piece;

a fastener engageable to the antenna assembly, for retaining the clamping piece and the one or more contact parts to the antenna assembly prior to mounting the antenna assembly to the mounting surface such that the antenna assembly, clamping piece, and one or more contact parts are positionable collectively as a single unit relative to the mounting hole;

the apparatus configured such that driving the fastener moves the clamping piece towards the mounting surface and into the one or more contact parts which elastically deforms the one or more legs thereby compressively contacting the one or more feet with the interior side of the mounting surface, whereupon:

a clamping force is applied to the mounting surface between the one or more feet along the interior side of the mounting surface and the chassis along the external side of the mounting surface; and the one or more feet and the one or more extensions are electrically coupled with the interior side of the mounting surface and an electrically-conductive portion of the antenna assembly, respectively;

wherein the one or more extensions are configured to extend from the one or more legs on the interior side of the mounting surface through the mounting hole to the external side of the mounting surface to galvanically contact an electrically-conductive portion of the antenna assembly along the external side of the mounting surface.

2. The apparatus of claim 1, wherein the one or more contact parts comprise first and second identical brackets.

3. The apparatus of claim 2, wherein:

each of the first and second identical brackets includes two legs each having two feet and one extension; and/or the first and second identical brackets are positioned at a ninety degree angle relative to each other.

4. The apparatus of claim 2, wherein the pressing angle between the clamping piece and the first bracket is different than the pressing angle between the clamping piece and the second bracket, such that the contact force between the mounting surface and each of the one or more feet is about equal.

5. The apparatus of claim 1, wherein the apparatus is configured such that the one or more contact parts undergo elastic deformation without undergoing plastic deformation during the mounting of the antenna assembly to the mounting surface.

6. The apparatus of claim 1, wherein the one or more feet are configured to press against and scratch the interior side mounting surface to thereby help provide a galvanic connection between the one or more feet and the mounting surface, when the one or more legs are elastically deformed by the clamping piece.

7. The apparatus of claim 1, wherein:

the one or more extensions are configured to galvanically contact or capacitively couple with the electrically-conductive portion of the antenna assembly; and/or the one or more feet are configured to galvanically contact or capacitively couple with the interior side of the mounting surface.

8. The apparatus of claim 1, wherein:

the fastener comprises a threaded bolt having a head and a threaded portion inserted through an opening of the clamping piece and then through the one or more contact parts and threadedly engaged to the antenna assembly thereby; and the threaded bolt is rotatable such that threaded bolt's head abuts against and moves the clamping piece to elastically deform the one or more legs.

9. The apparatus of claim 1, wherein:

the one or more legs have a generally V-shaped profile; and/or the one or more legs include spaced-apart flanges for slidably receiving a corresponding portion of the clamping piece for helping guide the movement of the clamping piece relative to the one or more contact parts.

10. The apparatus of claim 1, wherein the fastener is rotatable such that rotating the fastener moves the clamping piece.

11. An antenna assembly comprising the apparatus of claim 1, wherein the fastener is inserted through aligned openings in the clamping piece and the one or more contact parts and engaged to a corresponding portion of the antenna assembly thereby retaining the fastener, the clamping piece, and the one or more contact parts to the antenna assembly.

12. The antenna assembly of claim 8, further comprising one or more electrical connectors accessible from inside the vehicle, when the chassis is disposed along the external side of the vehicle body wall, for a pluggable electrical connection to at least one communication link.

13. An apparatus for mounting an antenna assembly having a chassis to a mounting surface having an external side, an interior side, and a mounting hole therebetween, the apparatus comprising:

one or more contact parts including one or more elastically deformable legs having one or more extensions and one or more feet;

a clamping piece;

a fastener engageable to the antenna assembly, for retaining the clamping piece and the one or more contact parts to the antenna assembly prior to mounting the antenna assembly to the mounting surface such that the antenna assembly, clamping piece, and one or more contact parts are positionable collectively as a single unit relative to the mounting hole;

the apparatus configured such that driving the fastener moves the clamping piece towards the mounting surface and into the one or more contact parts which elastically deforms the one or more legs thereby compressively contacting the one or more feet with the interior side of the mounting surface, whereupon:

a clamping force is applied to the mounting surface between the one or more feet along the interior side of the mounting surface and the chassis along the external side of the mounting surface; and the one or more feet and the one or more extensions are electrically coupled with the interior side of the mounting surface and an electrically-conductive portion of the antenna assembly, respectively;

wherein:

the one or more contact parts comprise first and second brackets; and the pressing angle between the clamping piece and the first bracket is different than the pressing angle between the clamping piece and the second bracket, such that the contact force between the mounting surface and each of the one or more feet is about equal.

14. An apparatus for mounting an antenna assembly having a chassis to a mounting surface having an external side, an interior side, and a mounting hole therebetween, the apparatus comprising:

one or more contact parts including one or more elastically deformable legs having one or more extensions and one or more feet;

a clamping piece;

a fastener engageable to the antenna assembly, for retaining the clamping piece and the one or more contact parts to the antenna assembly prior to mounting the antenna assembly to the mounting surface such that the antenna assembly, clamping piece, and one or more contact parts are positionable collectively as a single unit relative to the mounting hole;

the apparatus configured such that driving the fastener moves the clamping piece towards the mounting surface and into the one or more contact parts which elastically deforms the one or more legs thereby compressively contacting the one or more feet with the interior side of the mounting surface, whereupon:

a clamping force is applied to the mounting surface between the one or more feet along the interior side of the mounting surface and the chassis along the external side of the mounting surface; and the one or more feet and the one or more extensions are electrically coupled with the interior side of the mounting surface and an electrically-conductive portion of the antenna assembly, respectively;

the apparatus further comprising a sleeve disposed generally between the clamping piece and the one or more contact parts, the sleeve at least partially outside the clamping piece when the sleeve is being retained to the antenna assembly by the fastener prior to mounting the antenna assembly to the mounting surface, whereby driving the fastener moves the clamping piece which movement positions the sleeve at least partially within the clamping piece and into contact with corresponding portions of the fastener and the one or more contact parts after the antenna assembly is mounted.

15. The apparatus of claim 14, wherein:

the fastener, the sleeve, and/or the one or more contact parts comprise metal; and the clamping piece comprises plastic or metal.

16. An apparatus for mounting an antenna assembly having a chassis to a mounting surface having an external side, an interior side, and a mounting hole therebetween, the apparatus comprising:

one or more contact parts including one or more elastically deformable legs having one or more extensions and one or more feet;

a clamping piece;

a fastener engageable to the antenna assembly, for retaining the clamping piece and the one or more contact parts to the antenna assembly prior to mounting the antenna assembly to the mounting surface such that the antenna assembly, clamping piece, and one or more contact parts are positionable collectively as a single unit relative to the mounting hole;

the apparatus configured such that driving the fastener moves the clamping piece towards the mounting surface and into the one or more contact parts which elastically deforms the one or more legs thereby compressively contacting the one or more feet with the interior side of the mounting surface, whereupon:

a clamping force is applied to the mounting surface between the one or more feet along the interior side of the mounting surface and the chassis along the external side of the mounting surface; and the one or more feet and the one or more extensions are electrically coupled with the interior side of the mounting surface and an electrically-conductive portion of the antenna assembly, respectively;

wherein an electrical grounding path from the mounting surface to the chassis is formed after the antenna assembly is mounted to the mounting surface, via the electrical coupling of the one or more feet and the one or more extensions with the interior side of the mounting surface and an electrically-conductive portion of the antenna assembly, respectively.

17. The apparatus of claim 16, wherein the one or more extensions are configured to extend from the one or more legs on the interior side of the mounting surface through the mounting hole to the external side of the mounting surface to galvanically contact an electrically-conductive portion of the antenna assembly along the external side of the mounting surface.

18. The apparatus of claim 16, wherein:

the one or more extensions are configured to extend from the one or more legs on the interior side of the mounting surface through the mounting hole to the external side of the mounting surface to galvanically contact the chassis along the external side of the mounting surface; and/or the one or more feet galvanically contact the interior side of the mounting surface.

19. The apparatus of claim 18, wherein the electrical grounding path further includes the one or more legs and the fastener which is in galvanic contact with the chassis.

20. An apparatus for mounting an antenna assembly having a chassis to a mounting surface having an external side, an interior side, and a mounting hole therebetween, the apparatus comprising:

one or more contact parts including one or more elastically deformable legs having one or more extensions and one or more feet;

a clamping piece;

a fastener engageable to the antenna assembly, for retaining the clamping piece and the one or more contact parts to the antenna assembly prior to mounting the antenna assembly to the mounting surface such that the antenna assembly, clamping piece, and one or more contact parts are positionable collectively as a single unit relative to the mounting hole;

the apparatus configured such that driving the fastener moves the clamping piece towards the mounting surface and into the one or more contact parts which elastically deforms the one or more legs thereby compressively contacting the one or more feet with the interior side of the mounting surface, whereupon:

a clamping force is applied to the mounting surface between the one or more feet along the interior side of the mounting surface and the chassis along the external side of the mounting surface; and the one or more feet and the one or more extensions are electrically coupled with the interior side of the mounting surface and an electrically-conductive portion of the antenna assembly, respectively;

wherein:

the one or more contact parts include a generally flat base portion; and the one or more legs include:

first and second inner portions extending from the base portion with an angle defined therebetween; and first and second outer portions extending from the respective first and second inner portions with an angle defined therebetween, the first and second outer portions including the one or more extensions and one or more feet at the ends thereof.

21. The apparatus of claim 20, wherein the clamping piece includes tapered surfaces configured for contacting the first and second inner portions of the one or more legs for elastically deforming the one or more legs when the fastener is driven and moving the clamping piece towards the mounting surface.

22. An antenna assembly configured to be installed and fixedly mounted to a vehicle body wall after being positioned relative to a mounting hole in the vehicle body wall from an external side and nipped from an interior compartment side, the antenna assembly comprising:

a chassis configured to be disposed along the external side of the vehicle body wall;

a clamping piece having one or more tapered surfaces and an opening therethough;

one or more contact parts including:

a base portion having an opening therethrough and disposed between the clamping piece and the chassis; and one or more elastically deformable legs having a first portion that extends from the base portion generally away from the chassis, and a second portion that extends from the first portion generally towards the chassis and having one or more extensions and one or more ground pins;

a sleeve having an opening and disposed generally between the clamping piece and the base portion of the one or more contact parts;

a fastener inserted through the openings in the clamping piece, the sleeve, and the base portion of one or more contact parts, and engaged to a corresponding portion of the antenna assembly thereby retaining the fastener, the clamping piece, and the one or more contact parts to the antenna assembly;

whereby driving the fastener moves the clamping piece towards the base portion of the one or more contact parts, which movement drives the one or more tapered surfaces of the clamping piece into the first portion of the one or more legs and elastically deforms the one or more legs such that a clamping force is applied to the vehicle body wall between the one or more ground pins along the interior compartment side of the vehicle body wall and the chassis along the external side of the vehicle body wall.

23. The antenna assembly of claim 22, wherein the sleeve is at least partially outside the clamping piece when the sleeve is being retained to the antenna assembly by the fastener prior to mounting the antenna assembly to the vehicle body wall, whereby driving the fastener moves the clamping piece which movement positions the sleeve at least partially within the clamping piece such that the sleeve is compressively disposed between and in direct physical contact with a head of the fastener and the base portion of the one or more contact parts after the antenna assembly is mounted.

24. The antenna assembly of claim 22, wherein:

the one or more contact parts comprise first and second brackets; and the pressing angle between the clamping piece and the first bracket is different than the pressing angle between the clamping piece and the second bracket, such that the contact force between the vehicle body wall and each of the one or more ground pins is about equal.

25. The antenna assembly of claim 24, wherein:

the fastener is rotatable such that rotating the fastener moves the clamping piece; and/or the one or more ground pins and the one or more extensions are electrically coupled with the interior compartment side of the vehicle body wall and the chassis, respectively; and/or the antenna assembly includes one or more electrical connectors are accessible from inside the vehicle when the chassis is disposed along the external side of the vehicle body wall.

26. An apparatus for mounting an antenna assembly having a chassis to a mounting surface having an external side, an interior side, and a mounting hole therebetween, the apparatus comprising:

first and second brackets including one or more elastically deformable legs having one or more feet;

a clamping piece configured such that the pressing angle between the clamping piece and the first bracket is different than the pressing angle between the clamping piece and the second bracket;

a fastener engageable to the antenna assembly, for retaining the clamping piece and the first and second brackets to the antenna assembly prior to mounting the antenna assembly to the mounting surface such that the antenna assembly, clamping piece, and the first and second brackets are positionable collectively as a single unit relative to the mounting hole;

the apparatus configured such that driving the fastener moves the clamping piece towards the mounting surface which elastically deforms the one or more legs of the first and second brackets at the different pressing angles such that the contact force between the mounting surface and each of the one or more feet is about equal.

27. The apparatus of claim 26, wherein:

the first and second brackets are identical; and the one or more legs have a generally V-shaped profile; and the one or more legs include spaced-apart flanges for slidably receiving a corresponding portion of the clamping piece for helping guide the movement of the clamping piece relative to the one or more contact part; and the fastener is rotatable such that rotating the fastener moves the clamping piece.

28. An antenna assembly comprising the apparatus of claim 26, wherein the fastener is inserted through aligned openings in the clamping piece and the first and second brackets and engaged to a corresponding portion of the antenna assembly thereby retaining the fastener, the clamping piece, and the first and second brackets to the antenna assembly.

29. A method relating to mounting an antenna assembly to a mounting surface, the method comprising:

inserting a fastener through aligned openings in a clamping piece, a sleeve, and one or more contact parts having one or more elastically deformable legs with one or more extensions and one or more feet; and engaging the fastener to the antenna assembly to thereby retain the clamping piece, the sleeve, and the one or more contact parts to the antenna assembly prior to mounting the antenna assembly to the mounting surface, whereby the fastener may then be driven to move the clamping piece to elastically deform the one or more legs and reposition the sleeve at least partially within the clamping piece and into direct physical contact with a head of the fastener and a base portion of the one or more contact parts after the antenna assembly is mounted.

30. The method of claim 29, further comprising:

positioning the antenna assembly relative to a mounting hole in the mounting surface the fastener, clamping piece, sleeve, and one or more contact parts are at least partially inserted through the mounting hole; and driving the fastener to move the clamping piece to elastically deform the one or more legs such that:

a clamping force is applied to the mounting surface via the one or more feet;

the sleeve is repositioned at least partially within the clamping piece and in direct physical contact with a head of the fastener and a base portion of the one or more contact parts; and the one or more feet and the one or more extensions are electrically coupled with the mounting surface and an electrically-conductive portion of the antenna assembly, respectively.

31. The method of claim 29, wherein the mounting surface comprises a vehicle body wall having external and internal sides with a mounting hole therebetween, and wherein the method comprises from an external side of the vehicle body wall, positioning the antenna assembly relative to the mounting hole such that a chassis is disposed along the external side of the vehicle body wall and the fastener, clamping piece, sleeve, and one or more contact parts retained to the chassis by the fastener are at least partially inserted through the mounting hole;

from the internal side of the vehicle body wall, driving the fastener to move the clamping piece to elastically deform the one or more legs of the one or more contact parts such that the one or more feet of the one or more legs compressively contact the internal side of the vehicle body wall, whereupon:

a clamping force is applied to the vehicle body wall between the one or more feet along the internal side of the vehicle body wall and the chassis along the external side of the vehicle body wall; and the one or more feet and the one or more extensions are electrically coupled with the internal side of the vehicle body wall and an electrically-conductive portion of the antenna assembly, respectively.

32. The method of claim 31, wherein:

driving the fastener comprises rotating the fastener from the internal side of the vehicle body wall; and the method further comprises:

rotating the fastener in an opposite direction and removing the antenna assembly from the vehicle body wall; and remounting the antenna assembly using the same one or more contact parts.

* * * * *